United States Patent [19]

Eickmann

[11] Patent Number: 5,033,359

[45] Date of Patent: Jul. 23, 1991

[54] ROTOR PORTS, CONTROL BODY RECESSES AND A CONTROL PINTLE IN FLUID MACHINES

[76] Inventor: Karl Eickmann, 2420 Isshiki, Hayama-machi, Kanagawa-ken, Japan

[21] Appl. No.: 330,661

[22] Filed: Mar. 29, 1989

Related U.S. Application Data

[60] Continuation-in-part of Ser. No. 939,972, Dec. 9, 1986, abandoned, which is a continuation-in-part of Ser. No. 705,756, Feb. 25, 1985, Pat. No. 4,628,794, and a continuation-in-part of Ser. No. 799,779, Nov. 20, 1985, abandoned, which is a continuation-in-part of Ser. No. 589,268, Mar. 13, 1984, abandoned, which is a continuation-in-part of Ser. No. 228,484, Jan. 26, 1981, abandoned, which is a continuation-in-part of Ser. No. 911,246, May 31, 1978, abandoned, and a continuation-in-part of Ser. No. 910,809, May 30, 1978, abandoned, said Ser. No. 705,756, is a continuation-in-part of Ser. No. 421,677, Aug. 22, 1982, abandoned, which is a division of Ser. No. 109,577, Jan. 4, 1980, abandoned, which is a continuation of Ser. No. 910,809.

[51] Int. Cl.[5] ..... F04B 1/06

[52] U.S. Cl. ..... 91/498

[58] Field of Search ..... 91/492, 498

[56] References Cited

U.S. PATENT DOCUMENTS

| | | | |
|---|---|---|---|
| 1,998,984 | 4/1935 | Ferris | 91/498 X |
| 2,035,647 | 3/1936 | Ferris | 91/498 |
| 3,874,274 | 4/1975 | Knoblauch | 91/498 |
| 4,628,794 | 12/1986 | Eickmann | 91/498 |

*Primary Examiner*—Gerald A. Michalsky

[57] ABSTRACT

A fluid machine such as a pump, compressor, engine, motor or transmission has working chambers in a rotor and a concentric rotor - hub is provided in the rotor for the reception of a control body therein. The control body has control ports for the control of flow of fluid into and out of the working chambers of the rotor. Pressure fields form in the clearance between the rotor hub and the control body especially around the control ports. Leakage flows from the pressure fields through portions of the clearance between the rotor - hub and the control body which reduces the efficiency of the machine. Therefore, means are provided in the rotor or in the control body to press those portions of the faces of the rotor hub and of the control body, which have those local pressure fields, together, or to narrow the clearance between these faces in the respective areas where those pressure fields are located, in order to reduce the leakage through the clearance between the faces of the rotor hub and the control body.

15 Claims, 7 Drawing Sheets

Fig. 11
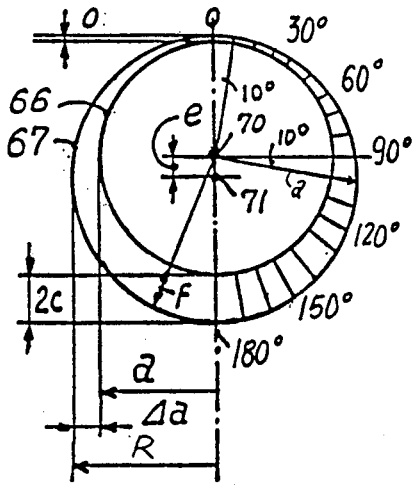
Fig. 7
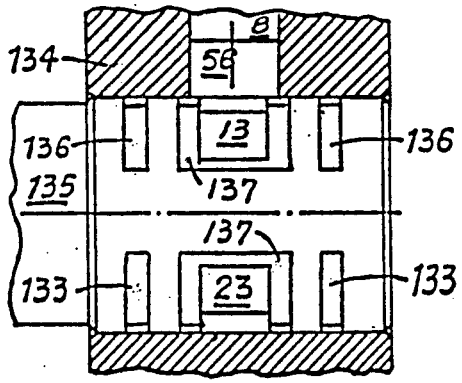
Fig. 8
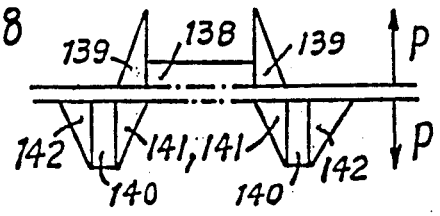
Fig. 12
| α° | 0 | 10 | 20 | 30 | 40 | 50 | 60 | 70 | 80 | 90 | Σ | 90 | 100 | 110 | 120 | 130 | 140 | 150 | 160 | 170 | 180 | Σ |
|---|---|---|---|---|---|---|---|---|---|---|---|---|---|---|---|---|---|---|---|---|---|---|
| F | 0 | .05 | .08 | .16 | .27 | .42 | .57 | .74 | .92 | 1.09 | | 1.09 | 1.27 | 1.43 | 1.57 | 1.70 | 1.81 | 1.90 | 1.95 | 1.99 | 2.0 | |
| $F^3$ | 0 | 0 | 0 | .01 | .02 | .07 | .19 | .41 | .77 | 1.31 | 2.77 | 1.31 | 2.05 | 2.89 | 3.88 | 4.86 | 5.88 | 6.86 | 7.43 | 7.86 | 8 | 51.05 |
| $F^3$ | 2.77/10 INTERVALS = 0.28 | | | | | | | | | | | 51.05/10 INTERVALS = 5.10 | | | | | | | | | | |
Fig. 9
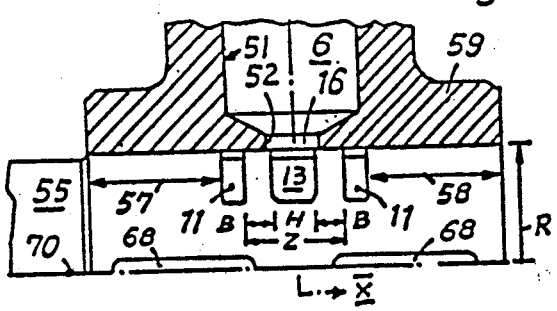
Fig. 10
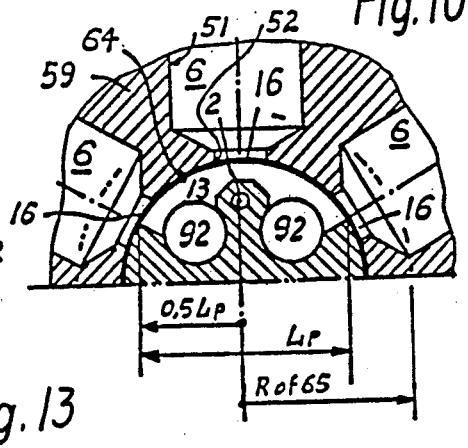
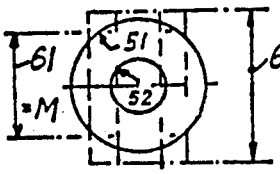
Fig. 13
51 = PROJECTION OF CYLINDER 6
52 = PROJECTION OF ROTOR PASSAGE 16
R = (DIAMETER OF "67")/2.
Lp = PROJECTION OF ARCH "L".
$L = 2R\pi\left[90° - \text{INV.COS}\left(\frac{0.5L}{R}\right)\right]2/360.$ Fig. 14
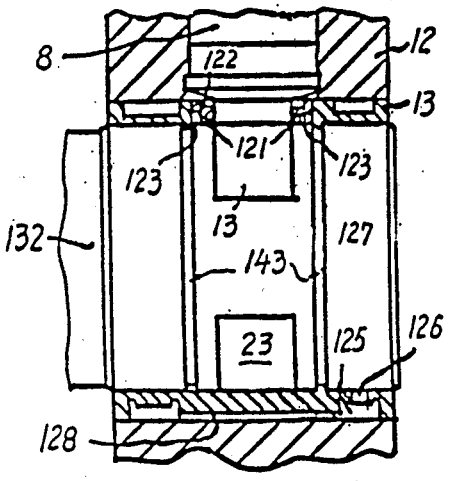
Fig. 15-A
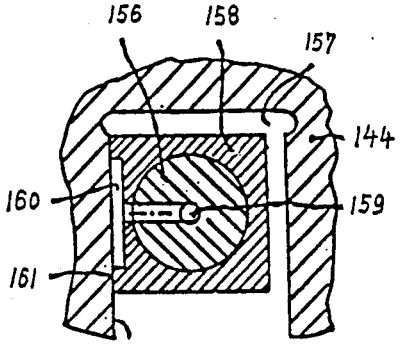
Fig. 16-A
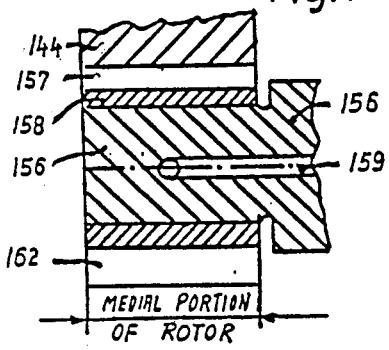
Fig. 15
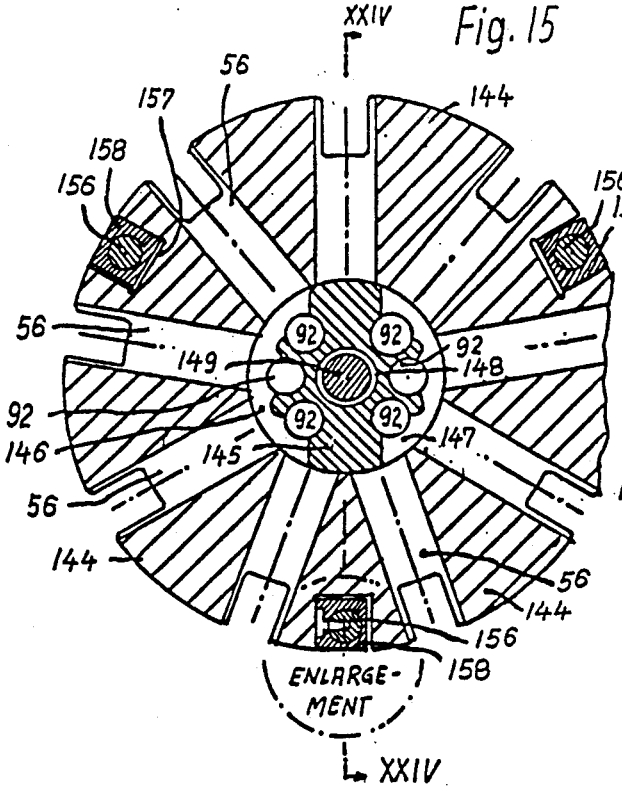
Fig. 16
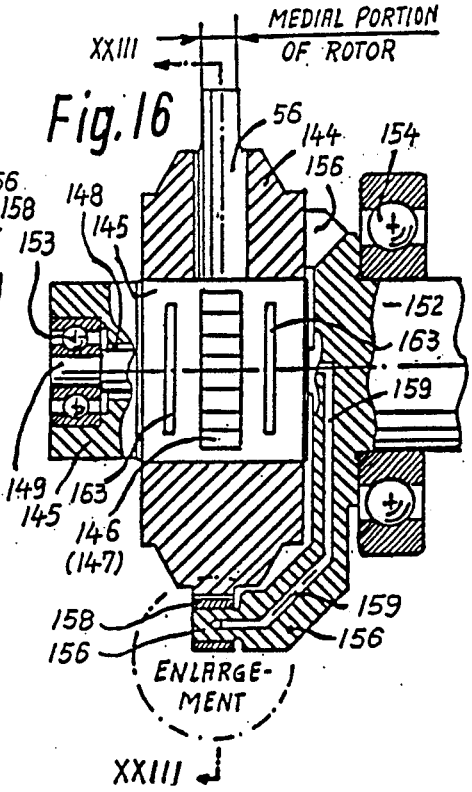

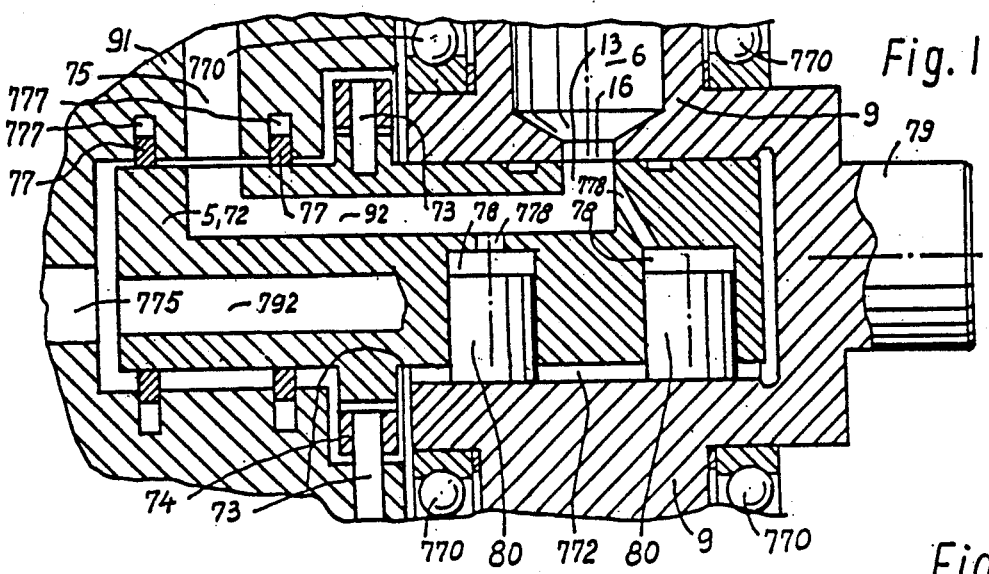
Fig. 17
Fig. 18
Fig. 19
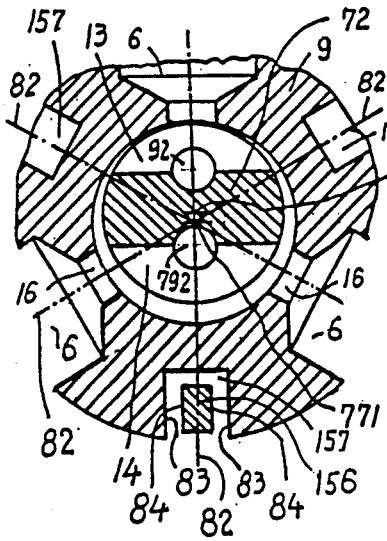
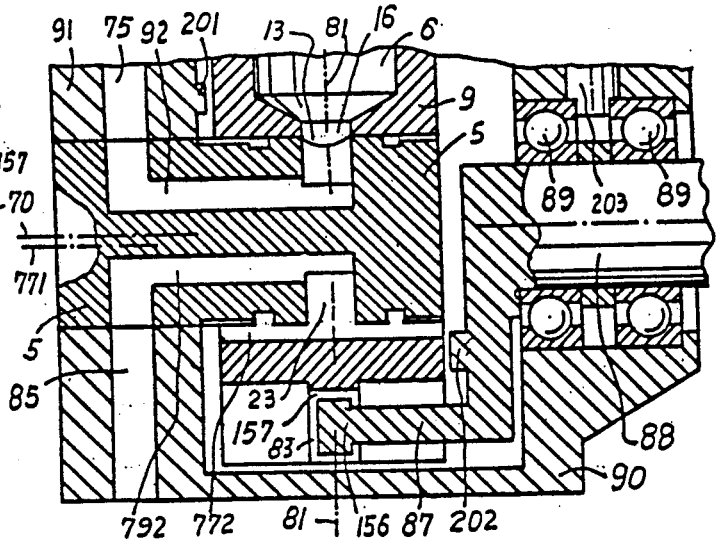
Fig. 20
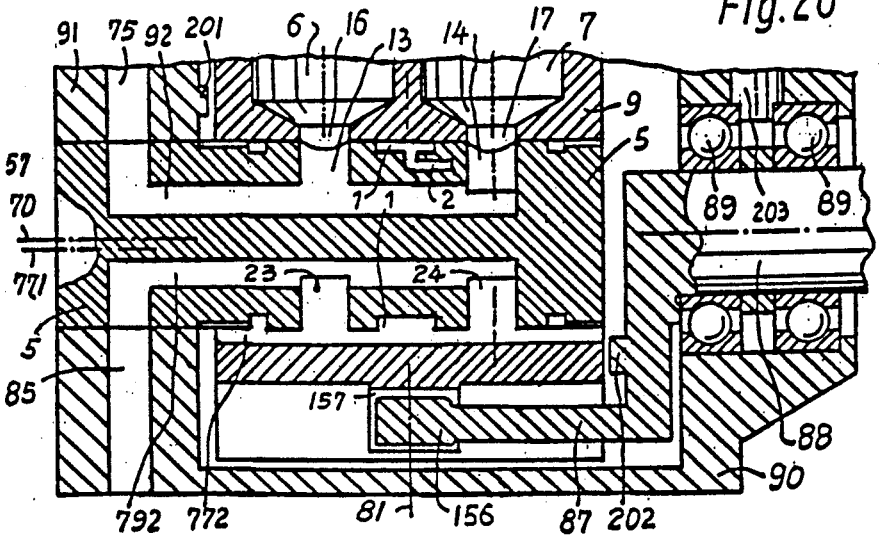

Fig. 32

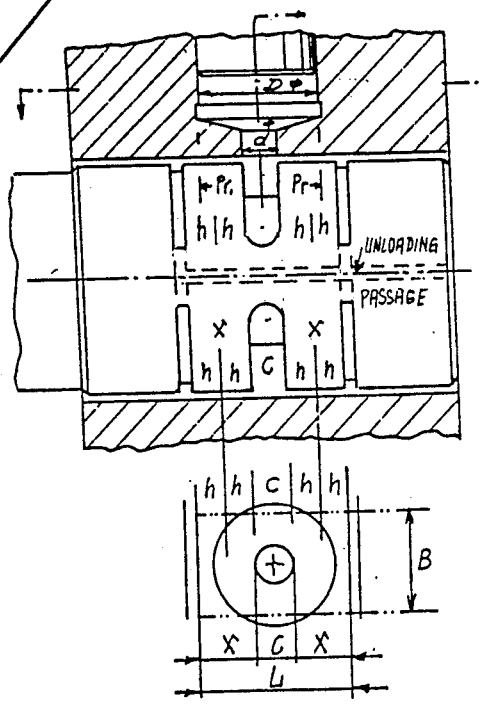

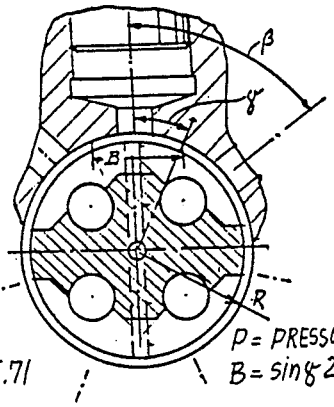

$n = 7$
$\gamma = 25.71$ $P$ = PRESSURE
$B = \sin\gamma\, 2R$ $n$ = NUMBER OF CYLINDERS; $\beta = 360/n$; $\gamma = \beta/2$

CONDITIONS ASSUMED:

a) PRESSURE DROP LINEAR; b) $C = d$ $$D^2\frac{\pi}{4}P > [CBP + (L-C)B\,P/2$$ BASIC CONDITION $$D^2\frac{\pi}{4}f_b = CB + (L-C)B\frac{1}{2};\quad f_b = 1.02 \rightarrow 1.20$$

$$2X = (L-C) = \left[2D^2\frac{\pi}{4}f_b - CB\right]2/B$$

CONDITION FOR REDUCED LEAKAGE: BY ECCENTRIC ROTOR, CLOSE TO CONTROL-PINTLE, IN HIGH PRESSURE PORT AREA. $\longrightarrow$ $$X = \frac{(L-C)}{2} = D^2\frac{\pi}{4}\frac{f_b}{B} - C$$

$f_b$ = RADIAL THRUST FACTOR.

SAMPLE: $f_b = 1.04$

| R | Φ D | Φ d | C | B | $D^2\frac{\pi}{4}\frac{f_b}{B}$ | X | h |
|---|---|---|---|---|---|---|---|
| mm | mm | mm | mm | mm | | mm | mm |
| 20 | 20 | 2 | 2 | 17.36 | 18.82 | 16.82 | 8.41 |
| " | " | 4 | 4 | " | " | 14.82 | 7.41 |
| " | " | 5 | 5 | " | " | 13.82 | 6.91 |
| " | " | 6 | 6 | " | " | 12.82 | 6.41 |
| " | " | 8 | 8 | " | " | 10.82 | 5.41 |
| " | " | 10 | 10 | " | " | 8.82 | 4.41 |
| " | " | 12 | 12 | " | " | 6.82 | 3.41 |
| " | " | 14 | 14 | " | " | 4.82 | 2.41 |
| " | " | 16 | 16 | " | " | 2.82 | 1.41 |
| " | " | 18 | 18 | " | " | 0.82 | 0.41 |

$B = 26.04$; $f_b = 1.04$

| R | $D^2\frac{\pi}{4}\frac{f_b}{B}$ | X | h |
|---|---|---|---|
| mm | | mm | mm |
| 30 | 12.54 | 10.54 | 5.27 |
| " | " | 8.54 | 4.27 |
| " | " | 7.54 | 3.77 |
| " | " | 6.54 | 3.27 |
| " | " | 4.54 | 2.27 |
| " | " | 2.54 | 1.27 |
| " | " | 0.54 | 0.27 |

$B = 34.71$; $f_b = 1.04$

| R | $D^2\frac{\pi}{4}\frac{f_b}{B}$ | X | h |
|---|---|---|---|
| mm | | mm | mm |
| 40 | 9.41 | 7.41 | 3.705 |
| " | " | 5.41 | 2.705 |
| " | " | 4.41 | 2.205 |
| " | " | 3.41 | 1.705 |
| " | " | 1.41 | 0.705 |

ROTOR PORTS, CONTROL BODY RECESSES AND A CONTROL PINTLE IN FLUID MACHINES

REFERENCE TO RELATED APPLICATIONS

This is a continuation in part of my co pending application, Ser. No. 06-939,972, filed on Dec. 09, 1986, now abandoned, which is a continuation in part application of my applications Ser. No. 705,756, filed on Feb. 25, 1985, now U.S. Pat. No. 4,628,794, and of my application Ser. No. 799,779, filed on Nov. 20, 1985, abandoned, as a continuation in part application of my earlier application Ser. No. 06-589,268 filed on 03-13-1984, abandoned as a continuation in part patent application of my still earlier patent application Ser. No. 06-228,484 which was filed on Jan. 26, 1981, abandoned, as a continuation in part application of my now abandoned patent application Ser. No. 911,246, filed May 31, 1978, which is now abandoned and also of my now abandoned application Ser. No. 910,809. The mentioned application Ser. No. 910,809 was filed on May 30, 1978 and application Ser. No. 911,246 was filed on May 31, 1978. Benefits of the above mentioned applications are claimed herewith for the respective Figures and disclosures of the present application. The oldest priority claimed thereby is that of application Ser. No. 910,809 of May 30, 1978. Application Ser. No. 06-228,484 is now abandoned. Application Ser. No. 589,268 is now abandoned. Application Ser. No. 06-705,756, issuing as U.S. Pat. No. 4,628,794 on Dec. 16, 1986 is a continuation in part application of the earlier application Ser. No. 421,677, filed on Sept. 22, 1982; now abandoned and which was filed as a divisional application of my application Ser. No. 06-109,577, filed on Jan. 04, 1980, now abandoned and which was filed as a continuation in part application of my above mentioned application Ser. No. 05-910,809. Benefits of the above mentioned applications are at least partially claimed for this present application. Application Ser. No. 799,779 is now abandoned.

BACKGROUND OF THE INVENTION a) Field of the Invention:

This invention relates to fluid machines which have a rotor or a body with working chambers therein. The body or rotor has a concentric bore, called "rotor hub" and a control body closely fitting therein. The control body has a cylindrical outer face and control ports are provided in the control body and its outer face to control the flow of fluid into and out of the working chambers.

Such machines are for example, known from my U.S. Pat. Nos. 3,062,151; 3,136,260; 3,223,046; 3,273,342; 3,270,685; 3,277,834; 3,304,883; 3,416,460; 3,747,639; 3,757,648 or 3,468,262 or others.

b) Description of the Prior Art:

It is known from my elder patents, for example from my U.S. Pat. Nos. 3,062,151; 3,136,260; 3,223,046; 3,273,342; 3,270,685; 3,277,834; 3,304,883; 3,416,460; 3,747,639; 3,757,648 or 3,468,262 or others, to provide a rotor hub in the center of the rotor of a fluid machine which may have either a single or a plurality of working chamber groups in the rotor of the machine.

A control body is inserted into the rotor hub and has control ports for the control of flow of fluid into and out of the working chambers of the rotor.

In order to counter balance the fields of pressure which surround the control ports and which include the control ports I have already in my mentioned elder patents provided diametrically located fluid pressure pockets in the control body to build up and maintain therein and therearound counter acting fields of pressure which act in the opposed direction onto the control body and thereby make the control body float with little or almost no friction in the rotor bore or rotor-hub.

These machines have proven partially to be of high efficiency and greatest reliability and of very little friction at low and medial fluid pressure ranges. They work also satisfactorily temporarly at higher pressures.

However at the very high pressures in fluid which are presently sometimes desired, a little more friction would be acceptable if the leakage could thereby be reduced.

Recently, a number of patents have been granted to inventors, which have assigned their inventions to the Bosch corporation of Western Germany. Those patents are, for example:

U.S. Pat. Nos. 3,810,418 of Paul Bosch; 3,875,852 of Paul Bosch; 3,866,517 of Ulrich Aldinger, 3,893,376 of Gerhard Nonnenmacher The latter mentioned patents have equivalent patent application publications (Deutsche Offenlegungsschriften) in Germany. These latter mentioned patents attempt to supply other or better solutions to my first mentioned elder own U.S. patents. However, the latter mentioned patents and applications deal with the same matter, as my previously mentioned elder U.S. patents, namely with the concentric floating of the control body in the rotor-hub. In all those cases, either the control body; floats in the rotor, or the rotor floats around the control body depending thereon, whether the rotor or the control body is flexibly mounted. At least all these mentioned patents and patent applications claim that the control body would float in a concentrical manner relative to the inner surface of the rotor-hub. As will be shown in the details of the invention, it is, however, not at all times assured, that the control body all times floats concentrically relative to the rotor-hub.

Some other patents in the field are U.S. Pat. Nos. 3,874,272; 3,874,274 or British patent 958,028.

My earlier patent application Ser. No. 910,809, now abandoned, defines unloading recesses on a control body or control pintle, which carries a rotor. The teaching and aim of the said application is, to force the rotor to float eccentrically relatively to the axis of the control pintle in order to bring the inner face of the rotor closer to the outer face of the control pintle in the high-pressure zone adjacent the high pressure control port.

The present invention now discovers, that similar means can be utilized to make the rotor float either centrically, eccentrically or float with a pre-determined limited eccentricity around the control pintle, when the unloading recesses are respectively located and when means to supply pressure fluid to actuate hydrodynamic pressure fields at partially eccentric or eccentric rotation of the rotor are added.

The invention thereby obtains reduced leakage or reduced friction and makes it possible to obtain any desired centric, eccentric or partial eccentric running of the rotor relative to the control-pintle.

The invention relates to fluid flow machines, wherein fluid flows through a control pintle into or out of working chambers in a rotor of such machine. The invention relates only to those of the above mentioned machines, which have substantially radially directed passage means to the respective chamber and wherein the cross-sectional area through the passage means is less than the cross-sectional area through the respective chamber, so, that a radial inwardly towards the control pintle directed force appears in the respective chamber of the rotor due to the fact, that a bottom is appearing in the chamber which is subjected to the pressure in the fluid in the chamber.

The machine may act as a compressor, pump, motor, engine or transmission.

My elder U.S. Pat. No. 3,223,046 of Dec. 14, 1965 shows a radial piston fluid flow machine, which has a control pintle which carries thereon a floating rotor. The cylinders are provided with passages towards the control pintle and the passages already have a smaller cross-section than the cylinders, whereby the mentioned bottom appears in the cylinders and provides a force onto the rotor, directed towards the control pintle.

The newer U.S. Pat. No. 3,866,517 of Mr. Aldinger of Bosch of Feb. 18, 1975 shows a similar machine as that of my elder U.S. Pat. No. 3,223,046 but with the addition of recesses which shall load themselves through the clearance between the rotor and the control body with a medial pressure. This patent provides the must of communication passages to send the pressure from the mentioned recesses to recesses on the diametric opposite portion of the control pintle. The Aldinger U.S. Pat. No. 3,866,517 fails to mention the known elder of my U.S. Pat. No. 3,223,046 as related former art.

SUMMARY OF THE INVENTION

It is therefore the aim of this invention to provide arrangements to reduce the leakage and/or friction on control bodies and rotors in fluid machines with single or plural working chamber groups. The invention is especially suitable for rotors which have a central rotor-hub of substantially cylindrical configuration and therein a relatively closely fitting control body of corresponding cylindrical configuration.

During the control of flow of fluid by the control body into and out of the rotor certain losses occur during this operation. The losses consist to a great extent of friction between the rotor hub face or rotor face and the outer face of the control body, and, in addition, of loss of fluid by leakage through the clearance between the rotor face and the control face of the control body, or through a portion or portions of said clearance.

In my previously mentioned patents the friction has been reduced to a very small minimum because the control bodies were forced by the means of my patents to float almost exactly concentrically within the rotor bore or rotor hub. The rotor face and the control face did, therefore, never touch each other and there remained no reason for friction by sliding of faces on each other. The remaining friction was only friction in fluid due to shear in fluid in the fluid film in the control clearance. Also, the leakage was reduced by my earlier patents because, when a body floats eccentrically in a bore, the leakage is 2.5 times compared to the leakage at a concentrically floating body in a bore. Since the means of my mentioned earlier patents forced the control body to float about concentrically in the rotor hub they thereby reduced the leakage almost 2.5 times compared to the devices and machines of the prior art prior to my mentioned patents.

In relation to the present invention it is desired that the total loss of the sum of friction and of leakage of the control clearance is minimized.

At low pressure the leakage losses were smaller than the friction losses, especially, when the machine ran with a high rotary speed. At medial pressures the losses of friction and of leakage at the places of the machine here under discussion were about equal. At higher pressures the leakage became a greater power loss than the friction, because the greater leakage sometimes even reduced the friction in my devices because the higher leakage forced the control body to float more concentrically than the smaller leakage could force the control body to do.

Presently, however, it is sometimes desired that the pump or motor act with pressures above 4000 psi permanently. Sometimes it is even desired to use hydrostatic bearings instead of roller bearings in order to obtain a high life time at high pressures. Further, some applications demand a reduction of leakage regardless of the sum of the power losses.

For these high pressure applications which appear sometimes presently it is desired to reduce the leakage between rotor face and control body at all costs. It is then accepted to have a little higher friction loss between rotor and control body when the leakage can thereby be drastically or at least considerably reduced.

It is therefore an object of this invention to reduce the leakage between rotor face and control face of the control body in a fluid machine, for example, in a pump, a compressor, an engine, a motor or in a transmission.

In order to materialize the object and aim of the invention, several novel arrangements may be associated to the control clearance between the rotor face and the control face of the rotor and control body of the machine, which may be applied either singly or, if suitable, in combination.

One of the main objects of the invention is also to reduce the number of flows of leakage, as well as to reduce the clearance, at least partially, where the main flows of leakage then occur.

The aim of the invention is at least partially materialized by the provision of the arrangement of the embodiment of the invention.

The main arrangement of the invention is, to provide at least one respective unloading recess in a control body which is inserted into the hub of a rotor and to communicate the unloading recess with a space of substantially no pressure. The unloading recess substantially parallels the ends of the respective control port in the control body and it is provided, at least partially, within the radial projection of the bottom of the cylinder(s) of the fluid machine. The bottom of the cylinder is the area between the cylinder and the cylinder port or passage. The cylinder port or passage has a smaller cross-sectional area than the cylinder. The unloading recess is partially within the radial projection of the cross-sectional area of the cylinder, but not within the cross-sectional area of the cylinder passage.

The arrangement of the invention consists also therein, that the rule of the location of the unloading recess(es) must become strictly obeyed. Departing the unloading recess(es) from the proper location would result in undesirable losses in the machine.

When the cylinder bottoms and the recess-distances from the control parts are correctly dimensioned and communicated, the clearance around the control port will narrow, while the control body face between the respective high pressure control port and the unloading recess(es) will seal the control port by gradually decreasing the pressure in the clearance parallel to the distance from the control port. The still flowing leakage will be reduced according to the desired and obtained reduction in size of the clearance around the high pressure control port. At the ideal solution of the invention, the leakage flows will be reduced to the flows directly out of the high pressure control port. Other leakage flows, such as out of recesses, should be spared.

There can be additional arrangements of the invention to aid the effects of the invention or to obtain other aims or objects of the invention. Those may appear later from the discussion or from the description of the preferred embodiments. To understand the arrangement of the invention better and the reason for it, some errors of the former art or limitations of the former art will now be discussed.

LIMITATIONS AND DIFFICULTIES OF THE PRIOR ART

It has been found in accordance with this invention that those arrangements of cylindrical control bodies which have balancing recesses and which are fully radially balanced, including my own earlier mentioned patents, are basically unstable, because the perfect balancing in itself is a labile solution. The perfect balancing itself does not provide a selfcentering effect. It just balances perfectly radially. The result, thereof, is that the test data of such devices are not at all times equal. They may differ with time and uncertain appearance, because a fully radially blanced control body may sometimes float concentrically, but at other times, without major reason, depart from the concentric position and run accentrically. It is just the labilety of perfect radial balancing, which makes, as the invention now discovers, the concentric running unstable. The difficulty of these of my patents were therefore at least partially labile and impermanent in results.

Further, they had many leakage flows, because they applied balancing recesses which were filled with pressure fluid. Leakage flows occured then out of the high pressure ports as well as out of the high pressure loaded balancing recesses. The great number of leakage flows restricted the efficiency and power of the machine respectively. The numbers of these kind of patents were already mentioned at the background of the invention.

There have appeared a number of recent attempts to manage the efficiency of fluid machines which have a rotor running around a cylindrical control body. For example, the West German DOS 24 33 090 of Bosch employs recesses in the control body, but fails to communicate them to a low or zero pressure space of the machine. The recesses, therefore, have no effect, and the recesses between the control ports of the same control body half fill fully with high pressure fluid. The rotor is, thereby, forced to run drastically eccentric with the wider clearance at the high pressure half of the machine.

U.S. Pat. No. 3,810,418 of Bosch employs recess portions on opposite control body halves, where the diametrically located recesses are communicated with each other. The recesses are thereby filled substantially with partial pressure between the low pressure and high pressure, because they are communicated to clearances of high pressure halves of the control body halves as well as to the low pressure halves of the control body. Since the recesses are filled with at least part-pressure, they can not permit the rotor to run close to the control body pressure half. There remains leakage and friction at considerable degree and extent. U.S. Pat. No. 3,875,852 of Bosch requires complicated valves in its attempts to reduce the leakage and friction between rotor and control body. But still then the result of the arrangement is minimal and hardly justifies the costs of the setting of the valve means. It further requires twelve recesses with communication and an additional ring groove. At same time it attempts to concentrate the concentric running of the rotor around the control body whereby then each high pressure or part pressure loaded recess of the twelve recesses will cause at least one or two leakage flows. The flows of leakage are therefore so highly numerous in the mentioned patent that the machine can not be efficient with small leakage losses.

U.S. Pat. No. 3,866,517 of Aldinger provides recesses in the neighborhood of the control ports, but communicates them to respective recesses on the diametric low pressure half. The recesses are, therefore, about half-pressure recesses. They are not communicated to low pressure spaces. They are not unloaded. The rotor bottoms are, therefore, not capable of pressing the rotor to close seal along the high pressure port. Further, all four balancing recesses make leakage flows, because they are not unloaded, but half-pressure loaded. The teaching of this patent, that the rotor runs concentric to the control body, indicates that there must be considerable leakage flows out of each of the at least four recesses. The mentioning of the concentric running further indicates that the device of the patent may be labile, which means unstable. Labile is explained earlier.

U.S. Pat. No. 3,893,376 of Nonnenmacher employs recesses all around the control body, whereby they meet the high pressure and the low pressure half of the control body. Thereby these recesses again become half pressure or part-pressure recesses with respectively many leakage flows or areas. As far as they are not all around the control body, they are again communicated, as the other patents with recesses and half- or part-pressure recesses. In addition the Nonnenmacher reference applies end-recesses which reduce the seal surfaces. The patent therefore still has too many leakage flows and appears to be incapable of obtaining an optimum of leakage- and friction-reduction.

U.S. Pat. No. 3,985,065 of Nonnenmacher has two ring grooves in the neighborhood of the control ports, whereby the grooves obtain a part-pressure all around the control body. The leakage is respectively high. The patent employs, in addition, four further recesses which are partially medial-pressure loaded and only partially low pressure communicated. The arrangement remains thereby incapable of limiting the leakage flows to one single high pressure control port per cylinder group of a machine.

U.S. Pat. No. 3,800,672 of KOBALD utilizes sometimes pressure, sometimes no pressure in the same thrust chamber. It appears to be, thereby, too unreliable to obtain any sure effect. In addition it is not applied on a cylindrical control body.

West German DOS publication 2 303 108 of Widmaier shows two control-body halves which are pressed by fluid pressure into sealing engagement with the rotary face of the rotor. This arrangement appears to be a genious solution, as long as it is looked into only superficially. A detailed study, however, shows, that it forms two gaps between the control body halves, wherethrough the pressure of the machine, which should pump, actually escapes.

U.S. Pat. No. 3,874,274 of Paul Bosch uses medial pressure in opposed recess pairs of the control pintle. Thereby it does not provide means to secure a specific eccentricty between the axes of the rotor and of the control body.

British patent 958,028 provides balancing recesses for a concentrically floating rotor or control body in the same way as my mentioned own earlier U.S. Patents use them.

U.S. Pat. No. 3,874,272, assumed to be issued to Paul Bosch, cuts away all bearing lands axially endwards of axially short sealing lands around the control ports of a control pintle. The sealing lands are axially so short that their axial outer ends remain within the radial projections of the cylinders. Thereby all guiding bearing lands are missed and such short sealing lands fail to provide a secure guidance of the running of the rotor relative to the control body. The rotors of this Patent will weld if no other means than those which are shown in the patent, are applied.

U.S. Pat. No. 3,906,998 to Robeller provides medial pressure recesses axially of the sealing lands of the control ports circumferentially all around the control body which incline and decline relative to the axial ends of the control body. Since these recesses are no unloading recesses they can not make the rotor to run with a defined eccentricity of the axis of the rotor relative to the axis of the control body.

U.S. Pat. Nos. 1,998,984 and 2,035,647 to Ferris show tapered control bodies in tapered rotor bores. The rotors are pressed by spring means towards the bigger end of the control pintle in order to let the rotor run with the smallest possible clearance around the control body. In these Patents pluralities of cylinder groups are set to common inlet and outlet rotor passages. The sealing lands axially endwards of the control ports of the control body are thereby partially in the radial projection of the respective group of cylinders. Unloading recesses are provided axially of the sealing lands. Since the control body is, however, not of cylindrical configuration, the pressures in the ports and along the sealing lands press the rotor axially away from its desired location against the mentioned springs. The forces play between the springs and the counter directed forces of pressure move the rotor axially respective to the control body in dependency on the pressures and the thrust performances of the springs. A definite size of the clearance between the rotor and the control pintle is thereby impossible for extended pressure ranges and a secure rate of reduction of leakage due to forces plays between the cylinder bottoms and the sealing lands axially endwards of the control ports of the control body can not be obtained and maintained.

And further, this invention discovers the following difficulties and drawbacks of the former art:

a) U.S. Pat. No. 3,223,046 fails to set unloading recesses, whereby the hydrostatic pressure fields and the hydrodynamic pressure field around the control pintle are not separated from each other. That led to welding between control pintle and rotor after 3 to 5 years of operation of the machine.

b) U.S. Pat. No. 3,866,517 partially fails to obtain its aims, because it forces by its arrangement the occurance of at least six leakage flows axially along the surface of the control pintle. The efficiency of the machine is thereby drastically reduced and the device can not obtain a maximum of power and efficiency.

c) Patents, related to U.S. Pat. No. 3,866,517 are particularly even subjected to more than six leakage flows, for example; DE-OS 2,433,090; U.S. Pat. Nos. 3,810,418; or 3,875,852; while U.S. Pat. No. 3,893,376 produces increased leakage by too short sealing lands.

These and other difficulties of the former art are at least partially reduced or overcome by the arrangements of the invention.

DETAILS OF ARRANGEMENTS IN SUMMARY OF THE INVENTION

The arrangements of the invention, which are applied, include in detail a bottom portion in the respective cylinders and at least two unloading recesses arranged parallel to the high pressure port, communicated to a low pressure space and located so close to the high pressure port, that the recesses partially enter the radial projection of the cylinder bottom.

Thereby the leakage flows are reduced to those flowing out of a single high pressure control port per cylinder group. Further, since the recesses are communicated to the low pressure space, the pressure drop along the seal face portions between the high pressure port and the recesses are clearly calculable and the pressure gradient is definite and stable, but not labile. The closeness of the recesses to the high pressure port which is in relation to the respective cylinder bottoms is also defined by the degree of entering of the respective recess portions into the radial projections of the respective cylinder bottoms, are designed and applied to enforce and at least partially stabilized running of the rotor relative to the control body to prevent instability of the sealing effects. Sealing lands axially endwards of the recesses may supply hydrodynamic concentering tendencies and forces in addition to the forces of fluid out of the cylinder bottoms and the control port clearance area.

The intention and aims and objects of the present invention, are, to reduce the drawbacks of the former art, which the present invention discovered in the former art and, especially to restrict the leakage flows in the device to a maximum of two major leakage flows. Separatedly provided hydrodynamic pressure fields may act to centre the rotor relatively to the control pintle in a desired and pre-determined extent.

The invention obtains its aims by providing a pair of unloading recesses beyond sealing lands of the high-pressure control port to co-operate with the pressure forces in the working chamber which are directed towards the control body.

Separated from the mentioned unloading recesses there may be provisions to supply a fluid pressure into a specific location or locations to build up hydrodynamic pressure fluid fields to carry the rotor in a pre-determined relationship relatively to the axis of the control pintle.

The invention also deals with the specific arrangements of supply slots, which act to supply respective fluid or fluid under specific pressure into the desired hydrodynamic bearing fields. While such hydrodynamic bearing fields might occasionally draw fluid into the respective clearance by suction pressure in such a clearance, the invention recognizes, that such a suction pressure is often too low or unsatisfactory to secure a proper loading of the hydrodynamic bearing field clearance or adjacent faces with a proper supply of fluid. Consequently, the invention also deals with and provides means for the proper supply of fluid into the respective supply slots of the invention. In specific arrangements of the invention, such means consist of specific grooves, passages, recesses or communications towards the respective supply slots.

While the details of the objects and arrangements have been described, it should be understood that the dimensioning of the arrangement portions relative to each other may depend on the desired revolutions per unit of time and also on the desired pressure per unit of area.

For example, in devices with great flow through quantities, but not very high pressures, the cross-sectional area of the rotor passages might be relatively large in comparison to the cross-sectional areas of the cylinders or working chambers. The sealing lands between the high pressure control port and the unloading recesses of the invention are then rather short and without the maximum of effectiveness. But that is all right for high quantity of flow devices.

When, however, the pressure is extremely high and the flow through quantity of fluid is small, the cross-sectional area of the rotor passages, entrances, exits or ports, may be made to a smaller fraction of the cross-sectional area of the working chambers or of the cylinders. The sealing lands between the high pressure control port and the unloading recesses of the invention are then rather extensive. Even at low revolutions the sealing of the high pressure port will then be effective. Especially, since at low revolutions per minute the rate of centering by hydrodynamic forces over the bearing lands is only little and the clearance between the outer face of the control body and the inner face of the rotor remains then, or becomes then, small in the area of the high pressure control port.

Thus, when all means of the invention are suitably applied, the machine may become effective for low rpm and high rpm.

BRIEF DESCRIPTION OF THE DRAWINGS

FIG. 7 is partially a longitudinal sectional view through a related device and partially it shows a control body in a view onto it.

FIG. 8 is an explanatory Figure related to FIG. 7 and shows a diagram of pressure forces.

FIG. 9 is a longitudinal sectional view through a rotor portion with a control body assembled therein in accordance with the invention, where the control body portion is seen in a view onto it.

FIG. 10 is a cross-sectional view through FIG. 9 along the line X—X.

FIG. 11 is a schematic explanatory Figure.

FIG. 12 is a table showing the results of a consideration of the invention.

FIG. 13 shows and explains the projection of the cylinders and rotor passages of others of the Figures and their relation to the matters of the control port in a schematic explanation.

FIG. 14 is a longitudinal sectional view through a portion of a device.

FIG. 15 is a cross-sectional view through FIG. 16 along the arrowed line.

FIG. 16 is a longitudinal sectional view through a portion of a machine.

FIG. 17 is a schematic Figure in longitudinal sectional view.

FIG. 18 is also a schematic Figure in longitudinal sectional view.

FIG. 19 is a cross-sectional schematic view through FIG. 18 along the arrowed line therein.

FIG. 20 is a longitudinal sectional view through an embodiment of the invention as it is provided, in combination, in the entire fluid machine.

FIGS. 15-A and 16-A are enlargements of portions of FIGS. 15 and 16.

FIG. 27 demonstrates, while it is partially demonstrating the cross-sections through FIG. 26, an other embodiment of communication.

FIG. 32 is a mathematic-geometric definition with a calculation.

FIG. 38 is a cross-sectional view through FIG. 33 along the arrowed line XXXVIII—XXXVIII of FIG. 33, while FIG. 35 is the sectional view along the arrowed line XXXV—XXXV of FIG. 33, however, with the control body 90 degrees turned illustrated.

DESCRIPTION OF THE PREFERRED EMBODIMENTS

At this description of the preferred embodiments a number of Figures are discussed, which are provided to give a better understanding of the technology involved or related to the invention.

By discovering the technologies involved in this present invention, it was, however, also found, that there are a plurality of possible solutions to solve the aims of the invention.

Not all of the solutions, however, utilize the same or equal elements of building of industrial machineries.

Consequently, not all of the Figures of the several possible solutions are included in the claims of the same patent application. Those Figures of this application, which utilize other elements, than those which are claimed in this present patent application, are therefore also provided in co-pending patent applications, wherein the respective claims are claimed.

The description starts with the solutions which appear in FIGS. 1 to 6, whereof FIGS. 1 to 6 show related solutions. FIGS. 1 to 6 and 9 to 13 bring the solutions, which will be claimed in this application or probable later divisionals thereof.

FIGS. 15, 16 and 17 to 19 define that there must be an ability to move radially relative between each other for the rotor and the control body of the invention. FIGS. 15 and 16 show one of several applicable arrangements therefore.

FIGS. 11, 12, 15, 16 and 17 to 19 are very important for the explanation of the technologies involved in the invention, which the invention has discovered. The solutions for the aims of the invention given in the other Figures, can not satisfactorily work, when the technologies which are explained in these Figures are not fully obeyed.

Figure 1:
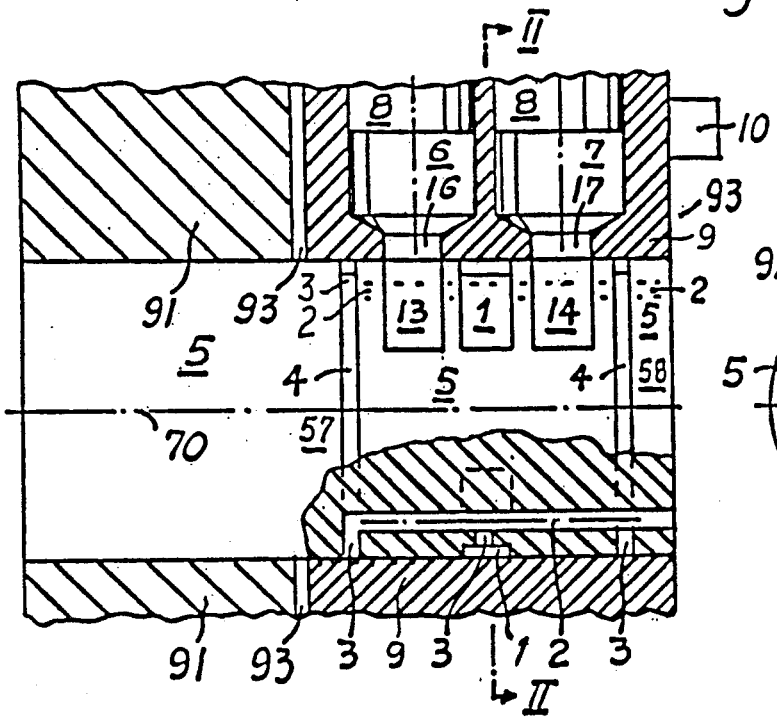
FIG. 1 is a longitudinal sectional view through the medial portion of a fluid machine which employs one embodiment of the invention.
Figure 2:
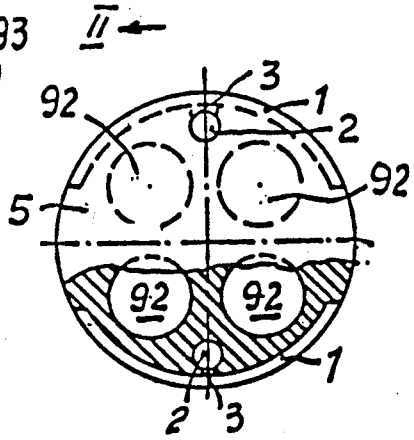
FIG. 2 is a cross-sectional view through FIG. 1 along II—II, and partially a view onto the control body therein from one end thereof in the direction of the arrow II.

FIGS. 1 and 2 are somewhat related to my earlier patents, for example to my U.S. Pat. No. 3,304,883. In said patent two cylinder groups, each consisting of a plurality of cylinders, are arranged closely together in a fluid machine.

The term "fluid machine" defines a machine which has chambers, which periodically take in and expel a fluid, such as hydraulic or pneumatic engines, compressors, pumps, motors or transmissions. From my U.S. Pat. No. 3,304,883 it is also already known that the cylinders are arranged substantially radially and that pistons move radially therein to take the fluid in and to let it move out of the cylinders through a substantially cylindrical control body which closely fits in the hub of the rotor of the machine. The flow of fluid to and from the cylinders occurrs through passages in the control body. The mentioned U.S. Pat. No. 3,304,883 also shows that the cylinders form ports, which are of narrower diameters than the cylinders.

Such arrangement is partially shown in FIGS. 1 and 2 wherein only the medial portion of the fluid machine is shown, because the invention concerns only the improvement of this medial portion, while the housing, the actuator means for actuating the piston strokes, the pistons and the ports are of conventional design and do not receive improvements by this invention. Consequently, in all other Figures, except FIGS. 15 to 20, also only the medial portions are shown, whereon or whereto improvements are done by this invention.

FIG. 1 demonstrates that the cylinders 6 and 7 of the adjacent cylinder groups 6 and 7 have ports 16 and 17 respectively, and that said ports have a smaller diameter than the respective cylinders. Pistons 8 are reciprocable in the cylinders 6 and 7, as known in the art. Due to the fact that the cylinders 6, 7 have wider diameters than the related ports 16, 17 they have also larger cross-sectional areas than the respective ports 16 and 17.

The consequence thereof is that when fluid-pressure builds up in the cylinders 6 and 7 it forces the rotor 9 down towards the control body 5 by a force p=pressure multiplied by the cross-sectional area through the cylinders minus the cross-sectional area through the ports. Thus, the difference of the cross-sectional areas through cylinders 6,7 and through the ports 16,17 defines at a given pressure in the cylinders the force with which the rotor 9 is forced against the wall of control body 5. Control body 5 is a stationary fixed control body, borne in housing or cover 91. Thereby it is defined that the control body 5 is not a floating control body, but a stationary fixed control body.

It defines also that the rotor is borne on the control body and not the control body borne in the rotor as it would be when the control body would be a floating control body. The control body 5 has control ports 13,14 for the control of flow of fluid into and out of ports 16 and 17 of the cylinders 6 and 7. Out from these control ports 13 and 14 a force acts also onto the rotor 9 in a direction contrary to that which acts out of the cylinders against the cylinder bottoms between cylinders 6,7 and cylinder ports 16,17. However, in case of the embodiments of the invention the force acting out of control ports is smaller than the force acting out of the cylinders, so that the rotor 9 is in the cases of the invention forced against the wall of control body 5 and borne thereby. More particularly, the rotor 9 is borne on the high-pressure half of the outer face of the control body of the respective Figure of the specification.

It could also be otherwise. Namely so, that the force out of the control ports 13,14 would be bigger than the force out of the respective cylinders. That is, however, not the case in the embodiment of FIGS. 1 to 6.

In the case of the embodiments of FIGS. 1 to 6 the rotor 9 is forced onto the control body 5 and that is desired in these embodiments.

The heretofore described actions of forces of fluid are, however, not the only actions of forces in fluid, but they act in combination with forces in fluid in the narrow clearance between the outer face of control body 5 and the inner face of rotor 9.

From ports 16 and 17 fluid under pressure enters the space between control body 5 and rotor 9. This force is over the entire axial extension from port 16 to port 17 equal to the pressure of the fluid in the cylinders 6 and 7. This pressure in fluid in the clearance between rotor 9 and control body 5 and between control ports 13 and 14 acts on such a large area between control ports 13 and 14 that the force of it is higher than the force onto the cylinder bottoms of cylinder—ports 6,16—7,17. Thus, the rotor is in this case no longer forced against the wall or outer face of control body 5, but away from it. Consequently the clearance widens between rotor 9 and control body 5 in the upper portion of FIG. 1 and leakage escapes from the cylinders 6 and 7 through the widened clearance between rotor 9 and control body 5 in the upper portion of FIG. 1.

Thus, by this invention it is discovered, that in a fluid machine with more than one cylinder group arranged around a substantial cylindrical control body, the rotor is not pressed against the outer face of the control body in the high pressure zone as desired, but on the contrary, it is pressed away from it.

After this discovery of the invention it will now be described how in accordance with this invention, the described effect is reversed by one embodiment of the invention.

To reverse the described undesired and leakage-providing effect, the recess(es) 1 is (are) provided in control body 5 between the control ports 13 and 15, in accordance with this invention. Also in accordance with this invention, the recess(es) 1 is (are) communicated to a space under low pressure or under no pressure. This may, for example, be done by the provision of bores 2 and 3 through control body 5 to communicate recess 1 with the free space on an end of control body 5. Depressurization bores or channels 2,3 may also be communicated to recesses or ring grooves 4 which may be provided in control body 5 or rotor 9 endwards and slightly distanced from control ports 13,14 and ports 16,17.

The provision of the unloading recess 1 prevents the high-pressure fluid area in the clearance between rotor 9 and control body 5 and between control ports 13 and 14. Instead, it provides a low pressure or no-pressure area between the ports. Thereby it is assured, that the desired effect of pressing the rotor 9 against the outer face of control body 5 in the high-pressure half of the machine is obtained.

The location and extension of recess(es) 1 if desired in combination with recess(es) 4 defines the forces-play between the fluid in the cylinders 6,7 and the clearance between rotor 9 and control body 5. Between control ports 13 and 14 and recesses 4 a pressure gradient appears in the clearance from high pressure in control ports 13 and 14 to low or no pressure in recesses 4. A similar pressure gradient appears between control ports 13 and 14 and the recess(es) 1. For calculation it is possible to consider a medial pressure of 0.4 to 0.5 of the high pressure in the cylinders. It is now possible to do an exact calculation for a desired thrust force to press the rotor 9 against the outer face of control body 5 by a respective location and dimensioning of recess 1 or of recesses 1 and recesses 4.

In the bottom of FIG. 1, which shows a portion of the control body in a longitudinal sectional view, it is illustrated, how passages 2 and 3 may be located in the control body 5. The same communication, as shown in the sectional view on the bottom of FIG. 1, is also provided in the top portion of FIG. 1. However, it is not actually visible there in the Figure, because the top portion of FIG. 1 is a view onto the control body, at which the interior communications inside of the control body are not visible.

FIG. 2 illustrates the same and in addition a sample for the peripheral extension of recesses 1. Fluid passages 92 of the known art appear in FIG. 2 in order to have FIG. 2 illustrate a true section through the control body 5 of FIG. 1.

Figure 3:
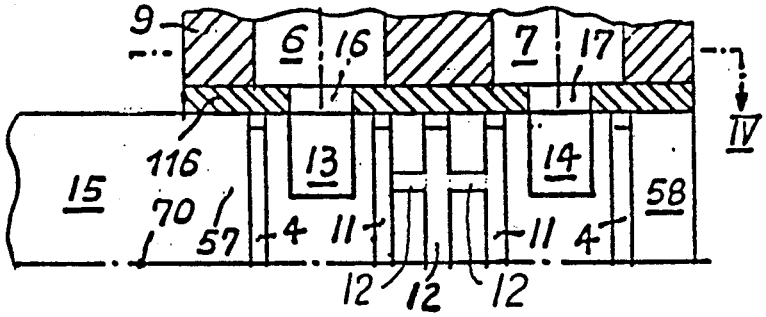
FIG. 3 is a longitudinal sectional view through a portion of fluid machine which contains another embodiment of the invention.

In FIG. 3 it is shown, that in accordance with this invention the recess 1 may be replaced by a couple of recesses 11. A further medial recess 12 may be added, if so desired. Thus, control body 15 may have either one or more recesses 11 and/or 4. It may also have an additional recess 12. The recesses 4,11,12 may extend either only partially in peripheral direction or completely around control body 15. These details depend on the desired design. A bush 16 may be inserted into rotor 9 to surround and seal relative to control body 5. This arrangement makes it possible to manufacture the rotor 9 with cylinders of equal diameter and straight radial walls. The rotor ports 16,17 of smaller diameter are then provided preferably in the bush 16 only for simplicity of manufacturing.

Figure 4:
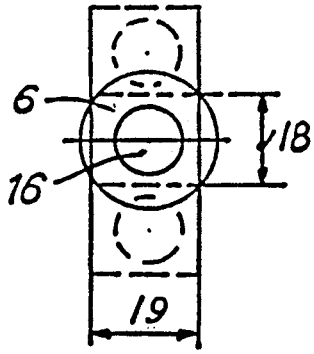
FIG. 4 is a longitudinal sectional view through FIG. 3 along IV—IV.

FIG. 4 shows as a schematic a section through FIG. 3 along the line IV—IV in order to show the cross-sectional areas of the cylinder 6 and of the cylinder port 16.

The area whereupon the pressure in the cylinder acts to force the rotor 9 towards the outer face of control body 5 is now area 6 minus area 16. If the diameter of the cylinder 6 is D and the diameter of the cylinder port 16 is d, then the area whereon the pressure "p" acts would be $(D^2-d^2)$ pi/4 and the force acting thereon would be:

$$P_{in}=HP(D^2-d^2)\pi/4 \quad (1)$$

The axial distance from the respective recess 4 to the respective recess 1 or 11 would be 19 and the peripheral distance from the middle between two ports 16 to the middle between the next ports 16 of the same cylinder group would be 18 in FIG. 4. High pressure HP would be present in cylinder port 19. The pressure in the area 18–19 would be about 0.4 to 0.5 HP. Thus the pressure acting in the clearance between rotor 9 and control body 5 towards the rotor 9 is:

$$P_{out}=0.4\sim0.5\ HP(18\times19)-HP\ d^2\pi/4 \quad (2)$$

and the forces play of forces between pressure in the cylinder(s) and the clearance between rotor 9 and control body 5 is then:

$$\Delta p=HP(D^2-d^2)\pi/4-[0.4\sim0.5\ HP(18\times19)-HP\ d^2\pi/b] \quad (3).$$

According to the invention, the dimensions of ports 16,17 in relation to cylinders 6,7 and the location and dimensions of recesses 1, 11, 4 are so arranged, that the force "F" of equation 3 gives such force, which is desired to exert the action of pressing the rotor 9 in the pressure area so against the outer face of control body 5, that the clearance narrows there to such an extent that a best possible seal against leakage will be obtained at the possible smallest friction between bush 16 and control body 5.

Figure 5:
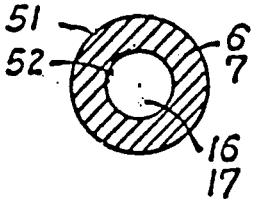
FIG. 5 is an explanatory schematic in relation to FIGS. 3 and 4.
Figure 6:
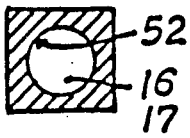
FIG. 6 is another schematic in relation to the said Figures.

From comparison of FIGS. 5 and 6, wherein FIG. 5 shows the area of equation (1) and FIG. 6 shows the area of equation (2) it can be seen, that any desired difference-area for the desired thrust of the rotor 9 against the outer face of control body 5 may be obtained by the respective location and dimensioning as discussed above. The same will also appear from FIG. 4, wherein the respective areas are seen drawn above each other for best possibility of comparison.

The clearance areas endwards of recesses 4 in FIGS. 1 and 3, which may extend either peripherially partially or entirely around the control body 5 or rotor 9 as well as the areas of the clearance axially between recesses 11 and 12 of FIG. 3, may serve for bearing the rotor for stable movement around the control body. They may also serve to provide hydrodynamic action and bearing between control body 5 and rotor 9. Their dimensioning and extension as well as their location will influence such desired bearing—or hydrodynamic—action.

Regarding FIGS. 1 and 3 it may also be noted, that in FIG. 1 the cylinders 6 and 7 may act in relation to a common flow of fluid and thereby have equal pressures in fluid. In such case a single recess 1 for both control ports 13 and 14 is suitable between those control ports in the control body 5. On the contrary thereto FIG. 3 illustrates cylinders 6 and 7 which may have different pressures in fluid and which may act in relation to different flows of fluid. Therefore, in the system of FIG. 3 two recesses 11 are provided. One is for co-operation with the flow of cylinder 6 and the other for co-operation with the flow of cylinder 7. Recess 12 between them may be provided or be eliminated according to the actual requirement.

As it is known from the former art, a control body or control pintle has one high pressure half and one low pressure half. When the flow of fluid through the device becomes reversed, the former high pressure half becomes the low pressure half and vice-versa. In reversible flow devices the control pintles or control bodies are therefore symmetric, showing upper portions and bottom portions in the Figures, which may selectively act either as high pressure halves or as low pressure halves. When the plane wherein the centric and eccentric axes of the rotor and of the piston-stroke actuator are located, is vertically in the device, the mentioned upper control body half may become the front half and the mentioned bottom half may become the rear half. However, since front- and rear-halves are difficult to be demonstrated in the plane of a sheet of paper, it is often customary in the Figures to show the control body or control pintle at 90 degrees turned in the respective Figure. This custom has become known to the artisans and is, therefore, often not specifically mentioned any more in the respective drawings or Figures.

Those recesses in the Figures which are communicated to a space or chamber under substantial low pressure are substantially of the same low pressure as the space is, whereto they communicate. When fluid flows from a respective clearance into the respectively communicated recess, the fluid which entered the recess immediately is subjected to the respective low pressure. This means, that the respective recess is unloaded from higher pressure and the respective recesses are therefore also called "unloading recesses".

The embodiment of FIG. 7 with the thereto belonging schematic of FIG. 8 illustrates that it has been found in accordance with this invention that it is not in all cases suitable to simply arrange a diametrically located and axially spaced pair of fluid pressure pockets respective to a control port of the control body. FIG. 8 is drawn below FIG. 7, whereby the forces which act in FIG. 7 are projected downward to be visible in FIG. 8. The invention recognizes, that, when the cylinder 56 is a straight through bore in rotor 134 there remains almost no action from the control port 13 against the rotor 134 or such thrust action by fluid is relatively small. This force is illustrated by 138 in the schematic FIG. 8. There is no radially inwards directed force out of chambers 6 onto rotor 134 in case of such straight radially through cylinders 56 in a rotor like 134. From port 13 the pressure gradients 139 appear on both axial ends of the port 13 in the clearance between rotor 134 and control body 135. Thus, the total pressure forces on the upper half of control body 135, if high pressure "P" acts in control port, 13 is "P"=139+138+139 of FIG. 8. Since the same high pressure P is led commonly into the oppositely diametrically located and axially spaced fluid pressure balancing recesses 133 on the bottom portion of the control body 135 at the same time act the pressure fields 142+140+141+141+140+142. These act opposed relative to the mentioned forces 139+138+139. The sum, which is the total force of fluid pressure on the bottom of the control body 135, is higher than the sum of the respective fluid pressure forces on the upper portion of control body 135. Therefore, the control bodies of the former art do not float relative to the rotor or vice-versa, as the former art, for example, of my earlier U.S. Pat. No. 3,062,151 teaches, but they are displaced eccentrically relative to each other and thereby provide high leakage and high friction which reduce the efficiency of the fluid machine. This is the case when the cylinder 56 is a straight through cylinder. But it is not necessarily so when the rotor port has a smaller diameter than the cylinder whereto it belongs.

It has now been found in accordance with this invention, that the eccentric displacement of the rotor relative to the control body can simply be prevented and the said rotor and control body can be made to float again concentrically relative to each other by the provision of a widened control recess 137 around the respective control port 13 or 23. Thereby the forces upwards in FIG. 8 become equal to the downward forces of FIG. 8 and the control body 135 floats concentrically again relative to the rotor 134. The increased leakage and friction is prevented and the device effective again. For loading port 23 the bottom recess 137 acts with recesses 136.

At the description of the earlier embodiments it has become apparent that there are two possibilities of location of the rotor relative to the control body. The one is that they float relative to each other on a common axis. The other is that they are relative to each other radially displaced so that they are eccentric relative to each other and that their axes are distanced from each other. Such distance is in practice less than a few hundredth of a millimeter and often only a few thousands of a millimeter. The said other possibility of eccentricity between rotor and control body is scientifically, technically and geometrically considered, an undesired and imperfect case. The ever increasing pressure in fluid machines, however, demands sometimes a compromise in favor of a tighter seal. It can therefore presently no more be entirely prevented to utilize even the imperfect appearing possibility of intentionally providing an eccentric running of the rotor relative to the control body or of the control body relative to the rotor in order to obtain a smaller clearance on the respective high pressure control port half of the control body and thereby to obtain a tighter seal and less leakage at the high pressure side of the clearance between rotor and control body. The market demands this application because the fluid machine shall be inexpensive and of little weight.

Such eccentricity between rotor and control body demands that the rotor be radially movable relative to the control body because during revolution of the rotor the rotor floats with its inner face one degree after the other a little bit towards the outer face of the control body at one half and away from it on the other half of a revolution. The flexibility or radial moveability of the rotor relative to the control body is already obtained in the former art by the insertion of a crosswise slotted disc between the shaft and the rotor of the fluid machine where fingers or extensions of the rotor and shaft enter cross-wise the slots of the crosswise slotted disc. This is also done in order to prevent offcentered running of the shaft to the rotor, because such offcentered running of the rought machined and borne shaft would stick and weld the more accurately machined inner face of the rotor on the outer face of the control body, because the clearance between them may be smaller than the accuracy of the bearings, which bear the shaft of the fluid machine.

FIGS. 7 and 8 show a matter where also clearance problems are involved as in the present application. However, these Figures do not show the particular matter which is claimed in this invention. The Figures are added to this specification to show that the disclosure of the invention can not simply be transferred to differently acting devices without taking into consideration the details of familiarly related, but not actually fully equal devices.

FIGS. 1 and 3 are not patentably different with respect to the rotor-cylinders and the passages, ports, entrances or exits thereto. For example the cylinders 6 and 7 as well as the rotor passages 16 and 17 of FIGS. 1 and 3 are patentably seen as the same matter. The insertion of the bush 116 is provided only for simplicity of manufacturing of straight through cylinders 6,7 in the rotor 9. But an additional reason for the insertion of bush 116 into rotor 9 can also be that the bush should be of a material which runs smoothly with the outer face of the control body 5, or 15. For example, when the rotor is made of bronze, the bronze has a higher heat expansion coefficient than the control body which may be of hardened steel. The clearance around the control body would then widen when the device becomes hot. It is then proper to make the rotor, for example, of cast iron, mihanite, dactail or the like, but the bush of a smooth running, relatively week bronze. The rotor then prevents a radial expansion of the bronze under heat higher than the expansion of the control body. The clearance between the control body and the bush is then kept almost constant over different temperatures of the device. The steel, cast iron or like of the rotor would, however, not run as smoothly along the outer face as the weak bronze would do. The insertion of the bronze bush or bush 116 is, therefore, often generally a matter for improving the safety, life time or efficiency and power of the machine.

FIGS. 9 to 13 are not taken from the parental application. They are added to the present continuation in part application as explanatory Figures.

Viewing FIGS. 9 and 13, it will be found that when the wall 51 and the wall of the rotor passage 52 are radially inwardly extended by imagination, they would form the radial projection of these walls onto the outer face of the control body. The circles 51 and 52 are thereby the projections of the walls 51 and 52 of the respective cylinder 6 and passage 16 onto the outer face of the control body. The area between the circles 51 and 52 is the bottom of the respective cylinder, or cylinder bottom, as occasionally cited in the application or in the specification.

When a single cylinder is considered, upwards of the control-body center line, the entire cylinder bottom is loaded with pressure, which tends to press the rotor 9 down to the control body. With $P = \text{force} = (D^2 - d^2)\text{-}(pi/4) \times p$ with p = pressure per area, for example, lbs or $Kg/cm^2$. "D" is the diameter of wall or projection 51, while d is the diameter of the wall or projection 52. The area within 52 is not acting on the rotor, because it is a bore, filled with fluid. Oppositionally directed is the force of fluid onto the rotor out of control port 13 in FIGS. 9,10,13 and the force of fluid in the clearance along the sealing lands between port 13 and recesses 11. Thereby the upwards directed area of fluid force in FIG. 13 is length 61 of port 13 × breadth "H" of port 13 minus the area of bore 16. Thereby the upwards oppositionally against the rotor directed force-area of high pressure is $Ahp = 61 \times H - d^2(pi/4)$ with d = diameter of 52. The area of the sealing lands is length 61 (because smaller diameter, see FIG. 10, and thereby shorter than 60 with radius 62 in FIG. 10) × 2 B. Since the pressure along the sealing lands B in FIG. 9 drops gradually from maximum of pressure at port 13 to zero pressure in the unloading recesses 11, the medial pressure in the sealing lands would roughly be half of the high pressure in port 13. Roughly shall means here that the actual pressure will not at all times exactly be the half of the pressure in high pressure port 13, because the pressure gradient is also influenced by heating up of fluid in the clearance. For a simplified calculation, however, the pressure in the sealing lands B will be assumed to be half of the high pressure in port 13,. Then the sealing lands become the high-pressure equivalent area $Ahpcl = B \times 61$. The sum of the upwards against the rotor directed force has now the total area of Ahp plus $Ahpcl = 61 \times H - d^2(pi/4) + B \times 61$.

For example, let D = diameter of 51 be 20 mm and d = diameter of 52 be 10 mm; H be 8 mm and B be 4 mm, we are getting, when the HP pressure is 100 Kg per cm square, when 61 is M = 16 mm;

$$F = (D^2 - d^2)(\pi/4)P - [M \times H - d^2(\pi/4) + B \times M]P = Kg; \text{ when measures are in cm.} \quad (4)$$

or; with the values of the above example:

$$F = (2^2 - 1^2)0.7854 - 100 - [1.6 \times 0.8 - 1^2 \times 0.7854 + 0.4 \times 1.6]100 = 106.16 \text{ KG},$$

with F = Kg = the sum of the forces or the resultant of the components of forces. The downwardly towards the control body directed forces are positive and the contrary directed, upwards against the rotor, directed forces are negative in the equation. The downward acting area is in the example = 2.3562 $cm^2$ and the contrary directed, upwards acting area is 1.2946 $cm^2$ or the downwardly acting resultant area is: 1.0616 $cm^2$ in the example of the calculation.

Heretofore a single cylinder was discussed. Now it will become explained at hand of the explanatory FIGS. 9 and 10, what the actual actions are. The control body 5 or 15 has the outer periphery of diameter × pi. In the high pressure half of the control body and rotor the high pressure is, however, acting only on the half of the periphery, namely along 64 of FIG. 10. This length of the high pressure arch is obviously not diameter × pi, but just approximately the half of it, namely diameter × 0.5 pi. On the other hand, the number of cylinders 6,7 in the half pressure half of the rotor may be N.

The action of the control clearance and of the cylinders is now not any more a single action, but only the actually upward and downward directed components of the forces are actions. The high pressure control port 13 has now, see FIG. 10, the length "L" as the upwards projection. And the downward projection of the cylinders is now (1/0.5 pi)×N. With (1/0.5 pi)=0.6366.

Since for the pressing of the rotor towards the control body or vice versa only the upward or downward projections are the acting areas, the downward directed force out of the cylinders is now Fdownwards=($D^2-d^2$) (pi/4)×p×0.6366×N. With (pi/4)=0.7854. The upwards directed force is, when the closing arch areas around the inner and outer dead points are neglected, Fupwards=L×(H+B)−$d^2$-(pi/4)×0.6366.×p. The total acting projected areas and forces are now:

$$\boxed{Ap = N(D^2 - d^2)(\pi/4)0.6366 - L(H + B) - d^2(\pi/4)0.6366 = \text{cm}^2} \text{ with measures in cm;}$$

or;

$$\boxed{Ap = N(D^2 - d^2)0.4999 - L(H + B)0.4999 = \text{cm}^2} \text{ with } \left(\frac{1}{\pi/2}\right)\frac{\pi}{4} = 0.4999; \quad (5)$$

and;

$$\boxed{Fp = [N(D^2 - d^2) - L(H + B)]0.4999\ P = KG} \text{ with cm and Kg/cm}^2. \quad (6)$$

Using L=32 mm=3.2 cm from FIG. 10 and the measures of the earlier calculated sample of a single cylinder, we obtain the following sample:

$$Fp=[3(4-1)-3.2 (0.8+0.4)]49.99=[9-3.84]49.99=258\ KG.$$

with which the rotor is pressed at these measures and pressure towards the control body.

It should be recognized here, that the invention works only when the unloading recesses can be set into the D−d projection. Otherwise, when the d-diameters of 52 become too big in relation to the D-51 diameters, the invention fails and the thrust bodies of my U.S. Pat. No. 4,782,737 or that of FIG. 17, must be applied.

Attention is now requested to FIGS. 11 and 12. In these Figures the rotor floats eccentricly relative to the control body. The inner face, rotor face, inner face of the bush or the rotary control face is shown by 66 while 67 presents the outer face or control face of the nonrotary control body for example 5 or 15. The rotor may be 9. Shown is the maximum of eccentric position, where on top the clearance "c" is zero and on the bottom equal to 2c. The clearance "c" is commonly also mentioned as "δ" (small greek delta).

The right side of FIG. 11 is divided by angles of ten degrees, whereby the radial measures "f" of the local dimension of the clearance "c" in radial direction appears. "f" can become calculated by the equations of my U.S. Pat. No. 3,320,897. Therefrom "f"=vane stroke in U.S. Pat. No. 3,320,897, is:

$$F=e\cos\alpha-(e^2/2R)\sin^2\alpha \quad (7)$$

with alpha=angle from the zero line through the centers (center and eccenter), and with "e"=eccentricity between the axes of the rotor and of the control body.

It is of some interest here that earlier in this specification it was mentioned that an eccentric clearance has 2.5 times the leakage of the centric clearance. This was taken from "Ernst, Oilhydraulic power and its industrial applications, Mc.Graw-Hill, New York", edition 1960, pages 46–45. Ernst's solution is, however, not entirely correct, because Ernst neglected the value ($e^2$/2R) $\sin^2$alpha. R is the diameter of 67.

And, further, the calculation of ERNST does not make sense to the present application. In the present application of the invention the leakage does not flow through the entire clearance, but only through the close clearance, namely through the upper half of FIG. 11. Consequently the equation to be used for an estimation of the leakage is my equation (7). Then it is to be recognized that the leakage flows with the third power of the radial size "f" of the clearance.

It has therefore become established in the table of FIG. 12, what the third powers of "f" are and they are summarized over the upper, the close half, and the bottom half, the wide half of the clearance.

When assuming the centric clearance value to be "1" for comparison, the table of FIG. 12 teaches that the leakage through the wider clearance half is about 5.10 times of that of a concentric clearance half, while the leakage through the closer half, the top half, is about 0.28 of the concentric clearance half. Or, in other words, the leakage through the wider clearance half is about 18 times larger than the leakage through the narrower, closer clearance half, when the full maximum of eccentricity is applied.

It will now be easy to understand that the devices of the former art, for example, my own and those of Bosch, Nonnenmacher, Aldinger etc., which tended to float the rotor concentric to the control body, would have a very disastrous leakage, when the concentric floating would become eccentric because they would have recesses in the wider half of the clearance, which are filled with pressure or half pressure of the HP pressure.

In this regard it should also be recognized, as will become apparent later or is already explained, that the concentric floating between a radial pressure balance is in itself labile, namely unstable.

This shows clearly how important it is that the recesses of the invention must be unloading recesses.

Applicant calls them intentionally unloading recesses, 1,4,11,12, to make it more clear that they are not half pressure or full pressure balancing recesses of the former art. The term "unloading recess" is justified thereby, that the recess ends the loading of the sealing lands with pressure and unloads the ends of the sealing lands "B" etc., endwards of the HP control ports to "zero" or to a pressure of zero, because of the communication of the recesses to the respective space under substantially no pressure or of only very low pressure.

Of further interest for the calculation of the leakage is the value L/B. It is commonly in balanced control bodies of cylindrical configuration about 30 to 200. The flow of leakage is directly proportionate to the value L/B in addition to the viscosity, pressure and the third power of "f".

Using the heretofore used values of the example, we obtain for FIGS. 9 and 10: L=2 times L, and B=B, since L appears twice, namely flowing of leakage from H in FIG. 9 to both recesses 11 along the "B" - s in both axial direction. With L=40 and B=4 mm, we obtain:

$$L/B=2L/B=80/4=20$$

which is about two thirds of the lowest respective value of the concentric floating radially balanced control bodies of the former art. Thus, the invention has reduced the L/B value roughly to at least the half and the flow through to 28% of the concentric floating device, whereby the leakage of the invention is roughly only 19 percent of the concentrically floating control bodies or rotors of the former art. When the labile control bodies of the former art with balancing recesses float fully eccentrically, their leakage is roughly $0.5\times5.1\times100/14\%=18$ times higher than in the present invention.

A still more perfect calculation of the relationships is possible by considering FIG. 10 again. The measure "Lp" is the projection of the high pressure control port 13 in the Figure. The length of "L", the sealing in axial direction, the arch, is according to the Figure:

$$L = 2R\pi[90^\circ - \text{Inv.cos.}(0{,}5L/R)]2/360^\circ. \quad (7)$$

In this respect it should be noted, however, that the rotor passages 16,17 may run over the peripherial end of the control port 13. The high pressure may then extend to the maximum of the periphery of the half pressure half of the control body. The projection thereof then is the diameter of the control body or "2R" in the Figure. This shows, that actually the length "L" steadily varies between "Lp" and "2R" when the device runs. With temporarily a larger length at the right side of the Figure and temporary at the left side of the Figure. The maximum of the projection however is "2R".

Equation (5) may also be written as:

$$A_p = (D^2 - d^2)(N/4) = B2R + H2R - d^2(N/4) \quad (8)$$

with 0.4999 simplified to 0.5;

wherefrom the complete radial balance can be obtained by transforming equation (8) to:

$$B_{rad.bal.} = [(D^2 - d^2)(N/4) - 2RH + d^2(N/4)]/2R \quad (9)$$

Therefrom the above measures sample gives a maximally permissible length of the sealing lands "B" of:

$$B_{rad.bal}=[(4-1)(7/4)-2\times2.1\times0.8+1(7/4)]/2\times2.1-$$
$$=0.866\text{ cm}=8.66\text{ mm}.$$

When this would be written in an actual design, the recesses 1, 11 or like would not enter the radial projection of the cylinder walls, but stay axially of them. It is therefore important, in accordance with this present invention, to define the half of the axial length of the sealing lands "B" between the HP control port and the begin or innermost wall of the respective recess 11 or like. It is this:

"the half length lines of the sealing lands (B) between the high pressure control port and the recesses (11) must be located partially (10) within the projection of the cylinder walls of the device."

This is thereby an important definition of the invention and mentioned in the claims thereof. When in the above numerical sample, a radial balance shall be present, "B" becomes 8.666 mm and "L" becomes maximally=2R-(pi/2)=40(pi/2)=62.8 mm; wherefrom for ΣL/B follows 125.6/8.66 or L/B=14.5 or roughly the half of the former art L/B values. For eccentric running the length "B" must be somewhat smaller than "$B_{rad.bal.}$".

When the values of measures of the above sample are used, with diameter "D" of referential 51 to be 2 cm or 20 mm; and the axial length of HP control port "H"=13 is 0.8 of the diameter "d"=52 of the rotor passage, the value "$B_{rad.bal.}$" becomes as follows, for different diameters "d":

| | | | | | | | | | | |
|---|---|---|---|---|---|---|---|---|---|---|
| diamter "*d*" | = 0.4 | 0.6 | 0.8 | 1.0 | 1.2 | 1.4 | 1.6 | 1.8 | = cm |
| *B* rad.bal. | = 1.35 | 1.19 | 1.03 | 0.87 | 0.71 | 0.59 | 0.39 | 0.23 | = cm |
| *L/B* | = 9.8 | 11.1 | 12.8 | 15.2 | 18.7 | 22.4 | 34.1 | 58.22 | = factor, |

wherefrom it is seen, that the sealing lands "B" between the respective control port 13 and the recesses 11 of FIGS. 9,10 are quite exceptionally long, and that the for the leakage important value L/B remains quite small as long as the diamter "d"=52 does not become too big in relation to the cylinder wall diamter "D"=51.

At the values of the above example, the half length of the sealing lands "B" between the high pressure port 13 and the unloading recesses 11, which is the important characteristic of the invention and defined in the claims, lies axially of the axis of the respective cylinder at the value 0.835 of the radius of the cylinder wall, which is exactly within the projection of the cylinder wall as defined in the claims.

For the radially balanced running, the above values apply. For the more recommended eccentric running, or load in the rotor towards the control body, the mentioned half length of the sealing lands "B" will be entered deeper into the projection of the cylinder walls. The half length "B" becomes then closer to the radial axes of the respective cylinders. For a highly applied thrust of the rotor towards the control body, the half length of the sealing lands "B" may become so close to the radial axes of the cylinders, that even the innermost walls of the recesses, and thereby portions of the unloading recesses 11,1, etc., are within the projection of the cylinders or working chambers. From the above sample it is seen, however, that that is not in all cases necessary.

Comparing the above results of the example with the references of centrically floating control bodies with fully or partially pressure loaded recesses in the control body, it is easily seen, that the half pressure recesses of the Bosch-references, etc., give two leakage flows out of each of the diametrically located recesses. That are at least four additional leakage flows. The flows out of the half pressure control ports can become considered as half flows because they reduce only to the half pressure. But still then there are remaining two more leakage flows at least than in the present invention. Further, since the control bodies are said to be concentric, centered, the flows are 1/0.28=3.6 times/2=1.8 times bigger than in the present invention. Thereby the high superiority of the invention over the former art is illustrated.

It is reminded now that in order to be able to float eccentrically relative to each other, there must be a radially flexible clutch means between the shaft or rotor and control body. Those can be a slotted disc, but a more perfect system is that of FIGS. 15 and 16 of this specification.

Referring again to FIG. 11, this Figure explains that when the downward thrusting force is too high, the rotor face will weld along the line of point "O" on the top of FIG. 11 along the control face or outer face of the control body. In short, faces 66 and 67 will weld at point or line zero in FIG. 11. This shows what caution is to be taken to dimension the D and d values and the B values in relation to D and d. To prevent any such welding, FIG. 9, where a single cylinder group 9 is provided with two recesses 11 axially of the port 13, but within the projection of "D", but not within the projection of "d", the bearing lands 57 and 58 are provided axially endwards of the recesses 11. They may be filled with low, medial or high pressure, for example, by the longitudinal or axial supply recesses 68. These axially extending recesses 68 shall not mainly supply a balancing force, but merely supply fluid into the clearance. The pressure therein can be low. Since the clearance endwards of the recesses 11 is now filled with oil, the running of the inner face of the rotor provides hydrodynamic forces in the clearance, which are roughly seen oppositionally directed to the forces acting on the cylinder bottoms. The hydrodynamic forces thereby are assisting the forces out of the HP control port 13 and of the sealing lands "B".

When the rotor revolves slowly the hydrodynamic forces in the outer sealing lands 57 and 58 are low. Control body and rotor are floating in the most eccentric position, similar almost as in FIG. 11. With increasing rotary speed of the rotor, the hydrodynamic forces in the outer sealing and bearing lands 57 and 58 are increasing. Thereby the respective balance of forces increases in the direction of letting the rotor depart from the eccentric into a more centric position relative to the control body.

At proper utilization of this effect by the proper location and dimensioning of the described recesses and diameters, the invention obtains an almost eccentric floating between rotor and control body at the desired speed and the floating becomes stable, without welding of faces 66 and 67 in the top "zero" line of FIG. 11.

The former liability and unstability of the radially balanced devices is thereby prevented, because a bigger eccentricity supplies bigger hydrodynamic forces. The device of the invention thereby acts "selfstabilizing" with regard to the size of the eccentricity. At the same time the leakage is considerably reduced, compared to the devices of the former art.

The embodiment of the invention of FIGS. 15 and 16 illustrates effective arrangements to permit and assure the required radial move-ability between the outer face of the control body 145 and the inner face of the rotor 144. For said purpose the arrangement includes the provision of radial recesses 157 in the rotor 144 or in a cross-slotted disc before the rotor 144 and the provision of extensions or fingers 156 of a cross-disc or of shaft 152 for the engagement onto at least one wall of said slot or slots 157. Shaft 152 may be concentrically borne in bearings 152 in the housing or cover of the machine and/or in the control body 145 by bearings 154 or 154 and 153. The control body 145 may be centric relative to said shaft 152, so that both have the same axis. The rotor 144 revolves a little bit eccentrically relative to said axis of said shaft and of said rotor, as known from earlier Figures of this specification. The engagement portions, extensions or fingers 156 of shaft 152 engage into respective slots 157 in rotor 144 for driving the same or to be driven by the same. The slots 157 are wider in radial direction than the fingers 156 or the fingers 156 are, and are able to move radially in or partially out of said slots 157. Thus, the fingers 156 are to a limited extent able to move radially in the slots 157 whereby the radial dislocation of the rotor relative to the shaft is permitted during operation and driving of one by the other.

For easy movement of the fingers 156 along the respective wall of the respective slot it is preferred to set slide shoes 158 around the fingers for engagement on a respective wall of the respective slot 157.

For a still better operation of the device and for easier radial movement of the rotor 144 it is possible to provide fluid pressure pockets between the fingers and shoes 156–158 or between the slot walls 162 and the thrust faces 161 of the slide shoes 158. These fluid pressure pockets lubricate the mentioned faces 161 and 162 or the faces between fingers 156 and shoes 158 relative to each other at their relative movement and they are reducing the friction between said faces. The fluid pressure pockets are shown by numbers 160 and they are filled with fluid under pressure through the passage(s) 159 which extend(s) through the finger(s) 146 and through shaft 152 into a space with fluid under pressure. For example to a respective high pressure port in the control body 145. Passage(s) 159 may for that purpose extend from shaft 152 into control body 145 and a sealing means—not shown in the Figure—may seal the extension of the respective passage 159 from the shaft 152 into the control body 145.

A stable bearing of the revolvable shaft 152 can be obtained, for example, by extending a portion 149 of shaft 152 through a bore 148 through the control body 145 for bearing the shaft 152 at both ends of the fluid machine.

For the precision of the driving of shaft 152 or of rotor 144 by the other of these two elements it is suitable to provide the slots 157 in the medial portion of the rotor 144 or on medial means in the middle between both axial ends of the rotor 144. In practice, however, it is often preferred to engage the rotor by the shaft or vice versa on one end of the rotor because the machining is then easier and the costs of the fluid machine is thereby reduced. For high quality operation the engagement of shaft and rotor on one end of the rotor is not so good technologically because it might result in an inclination of the rotor relative to the outer face of the control body. That might result in increased friction and leakage between them.

It is desired to make the fingers or arms 156 strong enough in design to prevent deformation.

The main care however is to be taken to the necessity, that the friction of relative radial movement between rotor 144 and shaft 152 remains less than the forces exerted by the several embodiments of the invention or by one of them for pressing the rotor and the control body together or for narrowing the clearance between them at the high pressure control port half of the control body.

Control body 145 may have control ports 146 and 147 and passages 92 as well as restriction recesses or balancing recesses 163 for the purposes as in other embodiments of the invention.

DESCRIPTION OF THE TECHNOLOGY INVOLVED

In the patents, which were mentioned in the first two groups of patents in the description of the prior art, it was attempted to let the rotor-hub's inner face and the outer face of the control body float concentrically relative to each other. All these patents of the former art demanded a concentric floating of the mentioned faces relative to each other. And all these patents provided or attempted to provide by one or the other solution, a radial fluid pressure balance between the mentioned faces of the control body and of the rotor. In those of the aforementioned patents, which are mentioned as my own patents in the first group of the mentioned patents, such radial fluid pressure balance was also partially perfectly obtained.

Relative to ports, which contained pressure in fluid there were diametrically, relative to the axes of the rotor and of the control body counter acting and oppositionally directed fluid pressure balancing pockets provided.

Great efforts have been made to apply these principles in practical application. Several thousand orders for supply of machines in accordance with the mentioned patents have been built and supplied to the industries. The delivered products were found very reliable and of little friction.

However, at the extensive testings of the devices in my laboratory and in laboratories of the companies which built the devices under my licenses, as well as in government institutions and in laboratories of technical universities and high schools in ASIA, AMERICA and EUROPE, occasionally some test data appeared, where suddenly an unusual high leakage occured. It was then generally assumed, that the data were either errors of measurement or "outrunners". They were considered to appear very rare and of no considerable influence to the application of the devices in industries and technologies.

However, I inquired deeper into the described experience of occasionally higher leakages. I considered that in the latter times the pressure in the devices should be increased to still higher values. That was especially desirable in some of the industrial applications. At these attempts and inquiries I noticed as follows:

The radial fluid pressure balance between the respective rotor and control body was perfectly obtained in design as well as in the actually built products. Thereby the rotors and control bodies had obtained the ability to float perfectly relative to each other between fluid pressure areas and fluid films.

The reasons for the occasionally higher leakages could therefore not be considered to occur from imperfect radial pressure balance.

By such considerations I found, that a radial pressure balance, even if absolutely perfectly obtained, makes it possible, that the rotor and control body actually float relative to each other, but it does not make sure, that they float relative concentrically to each other.

Because the radial pressure balance is in itself, even when it is perfectly obtained, not stable, but unstable regarding the concentric floating of the rotor and control body relative to each other. But, on the contrary, the rotor and control body can even at the most perfect radial pressure balance move locally relative towards each other, whereby they obtain an eccentricity between their axes. At such eccentric location relative to each other, the radial fluid pressure balance between the rotor and the control body must not in all cases be necessarily disturbed, but can be upheld or even may upheld itself.

In short, the control body may within the radial pressure balance within the hub of the rotor move in all radial directions at free will and obtain any eccentric location relative to the rotor-hub as it pleases the control body. I call this instability of concentric location "lability" and say, that the control body is labile when it is provided between fluid pressures of perfect radial balance in the respective rotor hub.

A non labile or stabil location of the control body in the rotor-hub may be better obtained, when the radial pressure balance is not absolutely perfectly provided. Because then the control body would be caused to float in a certain eccentric position in a defined radial direction of the eccentricity.

Thus, my new discoveries are reversing my earlier mentioned patents of the former art and consider an intentionally at least partially eccentric location of the control body within the rotor-hub instead of the concentric location, which was taught in my earlier patents and the Bosch corporation assigned patents of the discussion of the prior art.

Quite understandably I have for a long time hesitated to let the control bodies float at least partially eccentrically in the respective rotor-hub. Because I had twenty years ago intensively studied the Book of Walter Ernst: "Oilhydraulic power and its industrial applications" which was published 1960 at Mc. Graw Hill Book Co. of New York and which is today one of the leading standard books for Oil Hydraulics all over the world and which is also published in Russian and German languages. In this book it was proven on pages 46 and 47, that the leakage flow through eccentric annular spaces would be 2.5 times higher than through concentric spaces of equal sizes. In more detail the leakage flow would increase parallel to:

$$1+1.5\,e^2 \qquad (11)$$

with e=eccentricity between the respective cylindrical faces. For example of the rotor-hub and of the control body.

From this disclosure of the Ernst book I assumed, that the leakage of the devices with a control body in a rotor's hub would similarily increase, about in the relationship of equation-portion (1) of the book of Ernst, when the control body would not float concentrically to the rotor's hub. Therefore, I prevented or tried to prevent an eccentric location of the control body relative to the rotor-hub. I aimed to obtain the smallest leakage by letting the control body float concentrically within the rotor's hub in order to obtain e=0 and thereby the smallest leakage in accordance with the disclosure of Ernst.

For almost two decades it was unthinkable for me to obtain a decrease of leakage by an eccentric location of the control body. On the contrary I expected an increase in leakage, when the control body would become placed eccentrically within the rotor-hub. The many patents of the former art are showing how intensively I worked to obtain a perfect concentric floating of the control body. The later granted patents of the former art which were assigned to the Bosch company and which are also discussed in the discussion of the former art, seem to indicate, that even those inventors, which later after my inventions, tried to improve my inventions further or to go their own ways to obtain the perfect radial pressure balance, followed by earlier considerations of my earlier patents and followed the rules of Ernst in their attempts to obtain the minimum of leakage by making the control body centrically located in the rotor's hub by an attempted perfect radial pressure balance.

After my discovery, that the perfect radial pressure balance makes the floating and location of the control body in the rotor-hub in accordance with this invention labile and prevents the stability of location, I started to inquire more deeply. For that purpose I divided the annular spaces in the cross-sectional plane there-of into individual smaller spaces of boarderlines starting at the center of the control body, namely in the axis of the control body and departing therefrom radial under equal intervalls of angles. Thereby I obtained FIG. 11 of this specification.

Therein I intend to find the radial distance between the outer face 66 of the respective control body and of the respective inner face 67 of the rotor-hub. This distance is "f" in FIG. 11. Distance "f" can however not immediately become calculated. Therefore I wrote FIG. 11, wherein "70" is the axis of the control body; "71" is the axis of the inner face of the rotor-hub and "e" is the eccentricity between the axes 70 and 71. The radius of the outer face of the control body around "70" is "a" (partially called "r" in the following equations and the radius of the inner face of the rotor's hub around "71" is "a+αa", called "R". Then the distance from the axis of the control body to the inner face of the rotor-hub at the respective angular location of angle "alpha" is: "d"; wherefrom follows, that the desired distance "f" is:

$$F=a-r. \tag{12}$$

By imagining a rectangular line onto "a" in FIG. 11 and let it go through "71" in said Figure, the angles "alpha" and "beta" are calculable in the triangle with "a", "e"; "R"; "alpha" and "beta". One obtains thereby: (see my U.S. Pat. No. 3,850,201 for mathematical details)

$$a=e\cos\alpha+R\cos\beta \tag{13}$$

wherefrom over a somewhat longer procedure the following equations for "a" can be obtained under the basis of the desired angle "alpha":

$$a = e\cos\alpha + R - \frac{e^2}{4R} + \frac{e^2}{4R}\cos 2\alpha \tag{14}$$

or:

$$a = e\cos\alpha + R - \frac{e^2}{2R}\sin^2\alpha. \tag{15}$$

Since "a" is now calculable, the desired distance "f" will be found by equation (5). The distance "f" is then obtained by equation (9). Equation (9) gives a value "f" equal to the stroke of the vane in my vane-machinery patents, when used between two different rotary angles "alpha". With the mathematics now established, the FIGS. 11 and 12 can be discussed.

From the previous discussion of the technology involved it has become apparent that the size of the value "B/L" and the eccentricity "e" are of extremely high influence to the leakage of the machine.

Disregarded in this discussion are the values of those also very important influences which are not depending on the design and principle of the device, as for example, the influence of viscosity, fluid and difference between the diameters of the inner face of the rotor-hub and of the outer face of the control body. It is assumed that the user of the device applies the best suitable fluid and the designer applies the smallest possible clearnace or diameter difference between the outer face of the control body and the inner face of the rotor's hub in order to obtain the most efficient device.

The consequences of the considerations of the lability and unstability of the floating of the control body under full radial fluid pressure balance should be overcome by this invention in such a way that a stabilizing mechanism becomes established. This stabilizing mechanism shall be used by this invention to set or locate the control body into a predeterminded position relative to the rotor, and to use the stabilizing mechanism to maintain the location of the the control body relative to the rotor in the set position during the operation of the device. One of such mechanism is already partially discussed, namely the appearance of hydrodynamic fluid pressure actions.

According to this invention there are the following three stabilizing mechanisms possible and applicable:

Stabilizer "a":

A radial thrust field is built up in the respective cylinder (see FIGS. 1 to 6, 9, 10 and 13) and acts in contrary direction against the respective ports or pockets which contain fluid, of the control body. To obtain the desired stability, one of the forces in the sum of the fields, ports, or pockets, must be smaller than the sum of the opposing forces. Care must be taken that this does not lead to welding between faces under too strong a difference between the opposing forces.

Stabilizer "b":

A substantially radially directed thrust chamber is associated with the control body or provided in the control body or rotor while a therein radially moveable thrust member is pressed against a respective face and as a result thereof and of the reaction forces the inner face of the rotor's hub and the outer face of the control body are pressed towards each other for a closer engagement. Care must be taken that the thrust forces not become too high because too strong thrust forces might result in wearing, friction and welding of the mentioned faces on each other.

Stabilizer "c":

Arrangements become provided to create hydrodynamic fluid pressure action at desired places between the inner face of the rotor's hub and the outer face of the control body for the purpose to oppose the forces of stabilizer "a" or of stabilizer "b", whereby a respective relative speed between the mentioned faces will result in a specific rate of eccentricity between the rotor and the control body at each respective relative speed and pressure. The mentioned rate of eccentricity will be maintained as long as the same speeds and pressures are present. It will return to the said rate, when the speeds and pressures appear again and it will automatically adapt to the respective different rate of eccentricity for other pressures and speeds.

Stabilizer "d":

Arrangements become provided to create "secure areas of faces-portions" between the inner face of the rotor-hub and the outer face of the control body. These are added to the stabilizers "a" or "b". The respective force areas and sizes of the stabilizers "a" or "b" must be suitably dimensioned to correspond to the bearing capability of the applied secure areas of face-portions. This stabilizer will also, as stabilizer "c" does, locate the control body respectively partially eccentrically relative to the rotor depending on the respective pressures. It will regain the respective rate of eccentricity when the same forces and pressures appear again.

In the cases of application of the stabilizers "c" or "d" to stabilizers "a" or "b", no welding will appear between the faces and the friction and wear can remain small and will remain small, when the opposing forces and actions are accordingly dimensioned.

The "secure areas of face-portions" are the contrary of unsafe zones or of unsecure face areas. Such insecure or unsafe areas appear when no hydrodynamic forces act and adjacent faces are too close together. A theory of the secure zones and of the unsafe or insecure zones or areas is given in my U.S. Pat. Nos. 3,951,047; 4,212,230 and in my West German patent 2,500,779. In these patents the "insecure zones" are discussed at hand of the outer slide faces of piston shoes of radial piston devices.

Insecure zones are relatively large dimensioned areas or portions of faces. They have the tendency to weld to each other when no hydrodynamic pressure field between them is provided. It is, therefore, required to replace them by "secure face-portions". These are short face portions of mostly 2 to 6 mm width normal to their length and commonly applied as sealing lands around pressure ports, recesses or hydrostatic bearings as sealing lands therearound. They must become restricted in their width to the mentioned average of 2 to 6 mm by respective face-restriction recesses. Otherwise they will be of too large an area, which might lead to welding under lack of fluid at local places.

The difference between hydrodynamically acting faces and secure face portions as well as unsafe portions is not widely known today. For example, in the patent publication DE-OS 2,307,997 of West Germany, corresponding to U.S. Pat. No. 3,948,149; there appear many Figures for all of which hydrodynamic pressure action is claimed. However, the direction of extensions of the faces of the Figures are contradicting each other respective to the direction of movement relative to the complementary faces, where they are sliding along. The consequence thereof is, that the hydrodynamic forces claimed for all of the Figures actually appear on only some of them. On others there appear "unsafe areas" or "insecure zones". At others again there appear areas of "secure zones".

A company used its DOS 2,307,997 corresponding to U.S. Pat. No. 3,948,149; to go into opposition against my patent DE-AS 2,500,779 which was published by the German patent office. The three examiners of the board of appeals in West Germany upheld my U.S. Pat. No. 2,500,779 and fully rejected the opposer. The opposer thereafter went to appeal to the Supreme Patent Court of West Germany. On Dec. 17, 1980 the said Supreme Court also rejected the opposer fully and upheld my U.S. Pat. No. 2,500,779. From the respective files the difference of hydrodynamic bearing actions and insecure as well as secure zones is now publicly known, but the public has until now not taken much notice of it, so that presently still many mistakes appear in the application of the respective technologies.

The detailed calculations or empricial data of forces in hydrodynamic action and of forces and appearances in secure zones are extensive technologies, wherefore to give details would exceed this present specification. As far as knowledge about them is desired, the inventor may be accordingly contacted.

ARRANGEMENTS TO OBTAIN THE BENEFIT FROM THE TECHNOLOGY INVOLVED

If the rotor is borne on bearings on the control body as in the first half of the present century and the rotor is thereby centered to the axis of the control body whereby the axes of the rotor and of the control body are theoretically forced to coincide, the benefit of the arrangement of the thrust providing bottom portions of the cylinders in combination with the unloading recesses of the invention merely serve to prevent excessive loads and/or deformations on or of the control body or rotor.

If the device is provided with a fixed rotor and a floating control body, thrust bodies must be set into thrust chambers to secure the closeness of the high pressure control body half on the inner surface of the rotor.

Such device is basically demonstrated in FIG. 17. The rotor 9 is borne in bearings 770 in the housing 91 and thereby the rotor is able to revolve around its axis, but the rotor is fixed, which means, that the axis of the rotor is prevented from any radial movement normal to the axis. To obtain the benefit of the technology, which is involved in the present invention, the control body 72 should then be a floating control body. Such floating control body has a moveable control body axis which can be moved radially respective to the axis or even spherically respective to the centered location of the axis of the control body. The control body is then prevented from rotation by the fastening in a flexibility arrangement which permits the radial and/or spherical movement of the control body on pins 73 in a floating ring 74 while the ring 74 is cross wise held by other pins 73 in the housing 91. Radially moveable seals 77 are then provided in respective seal grooves 777 in housing portion 91 to seal the high pressure passage(s) 92 and to communicate the high pressure passage(s) 92 to the high pressure exit port 75. The low pressure passage 792 communicates respectively to the low pressure port 775. Thereby the control body 72 obtains its ability to move radially against a respective portion of the inner face of the rotor for a closer seal thereon. Such movement of the control body to a closer clearance and better seal on the high pressure half of the control body is, however, not automatically obtained by the floating control body. On the contrary, in the case of a floating control body arrangement in a fixed rotor, as for example in FIG. 17, thrust means must be provided to force the high pressure half of the control body into a close sealing engagement on the respective portions of the inner face of the rotor. Consequently, in FIG. 17 the thrust chambers 78 are provided in the opposite half of the control body 72 to have thrust bodies 80 substantially radially moveable therein. Passages 778 lead high pressure fluid from the high pressure passage(s) 92 into the thrust chamber(s) 78 to thrust against the bottom(s) of the thrust body(ies) 80 whereby the thrust body(ies) 80 presses (press) against the respective portion(s) of the inner face of the rotor diametrically respective to the axis of the control body. Thereby the control body 72 is lifted upwards in FIG. 17 and thereby forced into the close seal of the outer face of the control body at the high pressure half of the control body on the inner face of the rotor. FIG. 17 shows the thereby widened clearance 772 in the low pressure half between the control body 72 and the rotor 9, while the high pressure half appears in FIG. 17 as a single line to indicate, that the respective portion of the outer face of the control body in the high pressure half is very close to the respective portion of the inner face of the rotor 9. The sealing effect of the invention and the forces play of the cylinder bottoms 6, 16 with the high pressure control port(s) 13 and the unloading recess(es) 4, 11, is thereby obtained. The benefit of the technology, which is involved in the invention, is materialized.

In the embodiment of FIG. 14 the control ports 13 and 23 are provided in the control body 132. A bush 13 is inserted into the hub of rotor 12. Below cylinder 8 a radial chamber is provided through the bush 13 to meet the control port 13 and the cylinder 8. A radially inwardly moveable thrust body 122 is inserted into the radial chamber of the bush 13 to seal and fit on the wall of the chamber. In the radially outer bottom portion of thrust body 122 a recess 123 is provided to communicate with the unloading recess(es) 143 of control body 132. The bottom face of the thrust body is configurated to be be complementary formed respective to the outer face of the control body 132. Since the upper cross sectional area of thrust body 122 is subjected to the high pressure in cylinder 8 but the recessed portion of the bottom face of the thrust body 122 is by the recess(es) 123 subjected to the low or no pressure in the unloading recess(es) 143, the thrust body 122 is automatically pressed against the outer face portion of the control body 132 to seal with its seal portion 121 along the respective portion(s) of the outer face of the control body 132. Passages and outcuts 126, 125, 128 may be provided in respective portions of the bush 13 to press so obtained thinned portions of the bush 13 into sealing engagement on the respective portions of the outer face of the control body 132.

The self sealing effect of the technology which is involved in the invention is best obtained by a fixed control body and a floating rotor. A sample of such arrangement is given by FIGS. 15 and 16 with the enlargements thereof.

FIGS. 18 and 19 demonstrate the principles of such fixed control body and floating rotor arrangement. The control body 5 is with its rear end fixed in the rear housing portion 91. The shaft is centered and borne in bearings 89 in the front portion 90 of the housing. Since the shaft and the bearings are centered, they are fixed in the housing portion 90 in such a way, that the axis of the shaft is centered in the housing and prevented from radial and other movements while rotation of the shaft is permitted and its rotatability is provided by the bearings 89. The rotor 9, which must be in this case a "floating rotor" is freely set around the front portion or the control portion of the control body 5. Thereby the control body 5 extends into the hub of the rotor 9 and the rotor 9 is free to move radially respective to the control body 5. Since the slots 157 are provided in the rotor 9 to receive therein the fingers 156 of the shaft 88 and since the finger(s) 156 is (are)radially moveable in the slot(s) 157, the rotor 9 is also radially moveable respective to the shaft 88. Since the arrangements of the invention, namely the bottom portions of the cylinders, the areas between cylinders 6 and cylinder ports 16 as well as the high pressure control port 13 and the unloading recesses 11 of the invention are provided, the rotor is under the forces play of the technology which is involved in the invention, pressed downward in the Figures to closely meet the outer face of control body 5 in the high pressure half while providing the widened clearance 772 in the low pressure half of the device.

It is essential in the arrangement of the floating rotor on the fixed control body that the shaft is borne rigidly, that the drive or engagement fingers of the shaft 88 are rigid and underformable and that the meeting faces between the fingers and the rotor are provided in such a style that the friction at the relative movement between these faces is smaller than the fluid pressure resultant force of the high pressure area of the control body and rotor of the invention. Because, otherwise, the arrangement of the invention can not be effective and its aim would not be obtained. In this respect it is illustrated in FIGS. 18 and 19, that the device has a medial radial imaginary plane 81 which is normal respective to the axis 70 of the control body and to the axis 771 of the rotor. Longitudinal imaginary faces 82 are then provided to extend angularly spaced from the axis 771 of the rotor 9 whereby they extend normal to the medial plane 81. This is important, because in order to make the friction of the relative movement of the faces 84 along the respective face(es) 83 of the slots 157 of the rotor smaller than the forces of the fluid in the arrangement of the invention are, the faces 83 and 84 should be substantially parallel to the mentioned angularly spaced longitudinal and radial planes 82. An absolute parallelity may, however, not be obtained, since the axes 70 and 771 of the control body 5 and of the rotor 9 are distanced slightly from each other.

The insertion of slide shoes into the fingers 158 with rear ball part formed portions borne on hollow ball part beds in the fingers 158 would, however, assure an absolute parallelity of faces 83 and 84 to the plane 82.

FIG. 20 shows the single unloading recess 1 between the two ports 13 and 14 of the control body 5 of FIG. 7 with the rotor 9 of FIG. 1 in combination with a drive means substantially similar to that of FIG. 16. While FIG. 16 shows the control body partially seen from the outside, FIG. 20 shows it in a longitudinal sectional view and with the clearnace portion 772 between the control body 5 and the rotor 9 in the low pressure halve in a drasticly enlarged scale.

THE COMBINATIONS OF THE INVENTION

Thus, the invention obtains its best results when the arrangements of the invention, namely the bottom portions of the cylinders in combination with the high pressure control port(s) and the unloading recesses are combined with a floating rotor, borne on a stationary control body.

However, also the floating control body in the hub of a fixed rotor can be improved by the respective embodiments of the invention, while the invention is also, but less, effective on fixed rotors and control bodies with coinciding axes.

The rotor 9 is prevented from axial departure from its desired location by the holder faces 201 and 202 on the rotor, on the rear housing portion and/or on the shaft 88. The rotors of the fixed control body are thereby floating radially and axially on the control body 5 between the forces play on the cylinder bottoms and the respective portions of the outer face of the control body and between the holding faces 201 and 202. Any connection between the rotor 9 and any neighboring part or the shaft is prevented and the transfer of rotary movement from the shaft to the rotor or vice versa is exclusively done by meeting thrust faces which slide radially relatively to each other at the maintenance of the eccentricity between the rotor and the control body. The bearings 89 of FIGS. 18 and 20 are kept in place by the holding pin 203.

FIG. 20 illustrates the complete double group device with the pair of control ports 13 and 14, the single unloading recess 1 between these ports with the unloading passage 2 of recess 1 in combination with the bearing of the rotor eccentrically on the control body 5, the fastening of the control body in the housing portion 91, the bearing of the bearings 88 in housing portion 90 and the transfer means 87,156,157 between the in the bearings 89 borne shaft 88 and the thereto eccentrically revolving rotor 9. FIG. 20 is thereby a complete device of the fluid machine with an arrangement of an embodiment of the invention therein in combination with all means which are required to obtain an optimum of life time, power and efficiency from the embodiment of the invention.

In FIGS. 21 to 31 the control body or control pintle 20 is fastened in the housing portion 21 of the device. The control pintle has a cylindrical outer face 81 which bears thereon the rotor 22 of the machine. Rotor 22 contains a plurality of working chambers 23 wherein displacement means, for example pistons 24, may reciprocate. The control pintle 20 has channels 28 ending in control port 26 and channels 27 ending in control port 126. Control port 126 is diametrically located on pintle 20 relatively to port 26. The channels 27 and 28 pass fluid into or out of the ports 26 or 126. The rotor 3 has an inner face 82 which forms around the outer face 81 of control pintle 20 the control clearance 60 as known in the art.

From the inner face 82 lead rotor passages 25 to the respective chambers 23. The cross-sectional area through the passages 25 is considerably smaller than the cross-sectional area through the chambers 23, whereby a bottom 61 is formed in each chamber 23. The cross-sectional area of the bottom 61 is cross-sectional area through chamber 23 minus the cross-sectional area through passage 25. In most practical applications each chamber has one single individual passage 25 but there could be more such passages to the respective chamber 23. The rotor 22 has at least one chamber 23, but commonly a plurality of chambers, mostly an uneven number of chambers, for example, 5,7,9 or 11 chambers 23. Chambers 23 may be of rectangle or any other configuration. They may extend axially, radially or in a direction therebetween. They may be radial piston cylinders, axial piston cylinders, vane-boardered chambers of vane devices, chambers of gear, internal gear or trochoid gear pumps or motors.

The invention belongs however only to those chambers in rotors, which form a bottom 61 by a passage of smaller cross-sectional area than the cross sectional area through the respective chamber 23.

Fluid may flow through the channels of the control pintle 20 and ports 26 or 126 of pintle 20 and through passages 25 into or out of chambers 23, or fluid is kept stationary in chambers 23 by communication with ports 26, 126 and channels 27,28 of pintle 20.

When pressure acts in a respective chamber 23, a force is build up or maintained under said pressure in chamber 23 and directed against the bottom 61 and thereby directed towards the control pintle 20. Since at the presence of such pressure in fluid in chamber 23 the pressure acts in all directions and since passage 25 is communicated to the respective port 26 or 126 and to clearance 60 between the inner face 82 of rotor 22 and outer face 81 of pintle 20, the pressure in fluid of the respective chamber 23 also moves into the clearance 60 in the neighborhood of the respective passage 25. Or also into the respective port 26 or 126.

A sealing land is present adjacent the ports and passages 26,126, 25 and is shown by referential numbers 70. Sealing lands 70 extend axially along the outer face 81 towards the unloading recesses 1, which are provided through the face 81 into the control pintle 20.

The fluid which enters the clearance 60 or which is present there, experiences a drop in pressure along the clearance in the direction toward the respective recesses, for example 1 or 9. The pressure gradient may obtain a mean value of 0.4 to 0.6 of the pressure difference in passages 25 and in recesses 1 or 9 and for first calculations a medial pressure of 0.5 of said values may be assumed. An accurate value can be obtained by experimential testing, because it depends on temperatures, relative speeds etc.

When the passages 25 are bores and chambers 23 are radial cylinders, the schematic of FIG. 9 applies. The bottom 61 has then the area $(D^2-d^2)$ pi/4.

The associated area of the clearance where the pressure with 0.5 value acts, is then $51\times52$, as shown in FIG. 9.

The pressure gradient in the respective portion of clearance 60, defined by $51\times52$ in FIG. 9 provides a force in the direction against the respective portion of the inner face 82 and thereby in a direction contrary and oppositionally directed relatively to the force out of chamber 23 against bottom 61.

Figures 21, 22, 23, 24, 25, 26, 27, 28, 29, 30, 31:
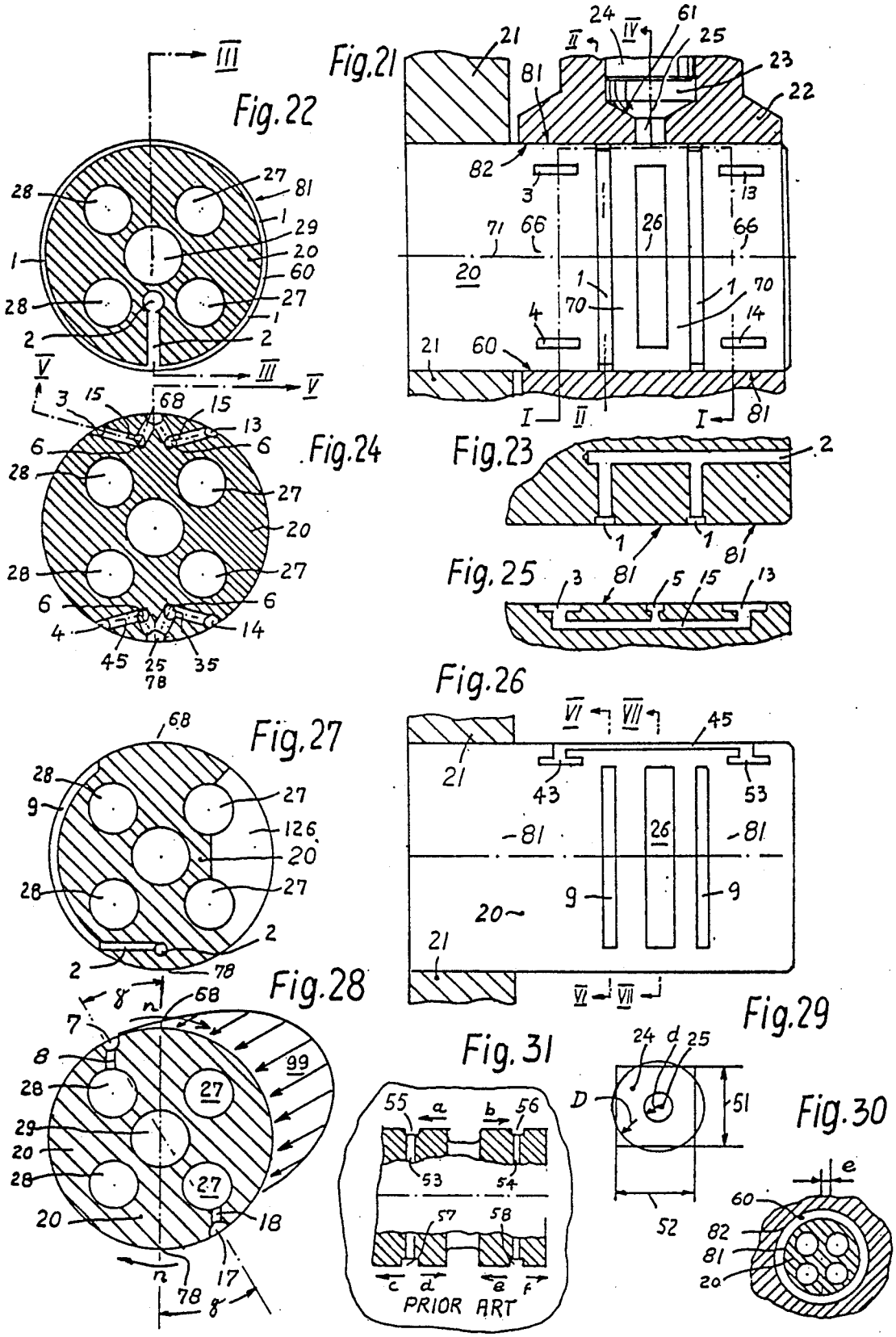
Fig.31 PRIOR ART
FIG. 21 is a longitudinal sectional view through one embodiment of the invention, wherein the control pintle is seen in a view onto it.
FIG. 22 is a cross-sectional view through FIG. 21 along the line II—II.
FIG. 23 is a sectional view through a portion of FIG. 22 along a portion of the line III—III.
FIG. 24 is a cross-sectional view through FIG. 21 along line I–IV, but demonstrates a modified embodiment of passages.
FIG. 25 is a sectional view through FIG. 24 along line V—V.
FIG. 26 is a view onto another embodiment of a control pintle of the invention.
FIG. 27 is in its left and right portions a cross-sectional view through FIG. 26 partially along lines VI—VI and VII—VII respectively.
FIG. 29 is a schematic, explaining the actions of forces, related.
FIG. 30 demonstrates the control clearance in an enlarged scale.
FIG. 31 demonstrates in a schematic the pluralities of leakage flows of the former art, which the invention reduces to a single pair of leakage flows.
FIG. 28 is a cross-sectional view through FIGS. 21 or 26 along the lines VI—VI or I–IV, but demonstrates an alternative of communication and the probable development of a sample of a hydrodynamic pressure field.

Thus, there is a force, which presses the rotor 22 towards the control port 26 or 126 or away from it of the size:

$$\text{Delta } F=[(D^2-d^2)\ \text{pi}/4]P-0.5\ (M\times N)\ P. \qquad (20)$$

wherein "M" stands for referential 51, "N" stands for referential 52 of FIG. 29; 0.5 is the pressure gradient in the clearance, namely the meanvalue thereof and may varify from 0.4 to 0.6 roughly. And, wherein "P" is the pressure in the fluid in chamber 23, passage 25 and port and channels 26,126,27 or 28 respectively.

So far the arrangement is principially known from the former art and also from my parental application.

The invention now discovers, that equation 1 can be utilized not only to let the rotor float centrically relatively to the axis 71 of control pintle 20, but also in any other desired position, for example, eccentrically or part-eccentrically.

Especially, when additional hydrodynamic pressure fields are artifically created to act in unision with equation 1.

It is therefore possible, in accordance with this invention, to reduce either the leakage or the friction in clearance 60 at will.

To obtain this aim, the invention provides:

In FIG. 1 and 2 the unloading annular grooves or unloading recesses 1 and communicates them by passage(s) 2 to a space under no or low pressure. When so required, passage(s) 2 and recess 1 can also be communicated for example via a valve or directly to the respective low-pressure port 26 or 126. FIG. 3 demonstrates the communication of unloading recesses 1 to the interior of the pump which will be under no pressure at this situation.

In FIG. 6 the annular grooves 1 are replaced by unloading recesses 9 of a restricted length substantially equal to the length of the respective port 26 or 126 and preferred to be parallel to said port 26 or 126. The passage(s) 2 is set similar to that of FIGS. 1, 2,3. The pressure in recess(es) 1 is thereby very low or zero.

The feature of this arrangement of the invention is, that only two flows of leakage appear out of the respective high-pressure control port 26 or 126, namely flows "a" and "b" of FIG. 11.

On the contrary thereto in the former art the passages 53 send a medial pressure also into the opposite recesses 57 and 58. Thus, there appear six flows of leakage in the former art of U.S. Pat. No. 3,866,517, namely a,b,c,d,e, and f, namely flows a and b from the control port, the center portion, to the medial pressure recesses 55 and 56 and the flows c,d,e and from the medial pressure recesses 57 and 58 to th low pressure or no pressure space in the housing. See FIG. 31.

Agreed, the pressure in these six flows is only half of that of the invention, and the leakage in each of the flows is only half of that of flows a and b of the invention, but two times one gives only 2, while six times one half gives three. Thus, the leakage is reduced at least by ⅓ relative to the former art device by this invention.

According to the Figures, the invention provides additional bearing portions 66 on the control body. These are located preferredly endwards of the unloading recesses 1 or 9 and form end portions of the outer face 81 of control body 20.

The invention now makes it possible, in addition to the proper dimensioning of the geometric values of equation 1, to create hydrodynamic pressure fields, for example, those of FIG. 28, shown by referential number 99.

To obtain this respective pressure field 99 of hydrodynamic action, a fluid pressure supply passage 45 or 5,6,15,35 or 8 extends from a space under pressure into the respective bearing portion 66 and supplies or maintains fluid in the area of clearance 60 over the mentioned bearing portions 66.

The supply passages port into slots 3,4,43 or 53, which extend in bearing face portions 66 in a direction parallel to the direction of axis 71 of control pintle 20, perpendicular to unloading recesses 1.

The mentioned fluid pressure supply passages may extend from the closing arc or from a space under high pressure. A number of samples of application of the supply passages are therefore shown in different Figures of the drawing. For example:

In FIG. 28 the supply passage 8 connects supply slots 7 with either one of the channels 27 or 28 of pintle 20. By this arrangement the device is reversible; meaning that at one direction of flow slot 17 is communicated by supply passage 18 to high pressure channel 27 and at the other direction of flow the slot 7 is connected by supply passage 8 to high pressure channel 28 of control pintle 20. FIG. 28 also illustrates, that it is suitable to provide supply slots 7 or 17 or also 3,13,43,53 in an angle before the control arch 68 or 78. Because, when the rotor 22 revolves in the direction of arrow "n" the distance of the slots 7,17 etc. has an influence on the rightward extension of the hydrodynamic pressure field 99 in the direction of rotation n of rotor 22. Therefore, the angle "$\gamma$" is shown in FIG. 28 and is commonly about 15 to 30 degrees before the respective closing arch. The line (face) of angle "$\gamma$" goes through the slots 7,17. The closing arch areas are the areas around referentials 68 and 78 of FIGS. 24, 27 and 28.

In order to create the hydrodynamic pressure field 99 it is required, that the rotor 22 floats a little eccentrically, as shown by eccentricity "e" in FIG. 30 in an enlarged scale, relative to control pintle 20, because the clearance 60 must reduce in distance between inner face 82 and outer face 81 in the direction "n" of rotor 22 towards the middle of the right side of FIG. 8, since otherwise no hydrodynamic pressure field 99 can build up.

FIGS. 24, 25 and 26 show the communication of the control arch 68 or 78 by supply passage(s) 5,15,6,45 and thereby of the respective passage 35 to the respective supply slot 3,13,4,14,43, 53 of pintle 20.

When this communication is provided, the control arch 68 or 78 respectively must be extending in the rotary direction "n" of rotor 22 in order, that the chambers 23 build up a pre-compression pressure, when their respective passages 25 revolve over the respective control arch 68 or 78; or gradually to reduce the pressure, when the respective passage 25 revolves from a high pressure port 26 or 126 over the respective closing control arch 68 or 78 towards a respective low pressure control port 26 or 126.

The communication to the control arch has the additional feature, that the pressure in the respective chamber 23 builds up or reduces over a larger angle "alpha" of rotation of the rotor. That reduces noise in the machine. In addition, the supply fluid is not taken out from the high pressure area but from a medial pressure area and therefore the power used to build up the fluid supply into the respective hydrodynamic bearing face portion is less, than when the communication of FIG. 28 is used.

The invention further obtains the following action and result, when so desired:

The centric floating of the rotor 22 around pintle 20 brings a leakage, similar to that described.

The fully eccentric floating of the rotor 22 around control pintle 20 leads to a close running of inner face 82 along outer face face 81 at least in one line and the neighborhood thereof, whereby the leakage reduces, but the friction considerably increases. Thus, the full eccentric floating is also not the final or best solution.

The invention is now able to dimension the relations of FIG. 29 and the areas of bearing face portions 66 to produce hydrodynamic pressure fields 99 to such desired perfection, that the hydrodynamic field 99 defines in combination with the matters of FIG. 29 a certain eccentricity "e" between faces 81 and 82 of FIG. 30, where the sum of the losses of friction and leakage in the control clerance 60 becomes a minimum. The invention thereby obtaines a considerable increase of efficiency and power of the respective device.

The details of the invention may be applied single or in combination, depending on cost or desire to perfectness of the device.

For the actual technology involved in the invention, it is important to either provide the creation of hydrodynamic forces over the outer bearing lands 57 and 58 or to prevent the building up of hydrodynamic forces there. In the latter case, the axial extensions of the outer portions 57, 58 of the control body may be axially short or interrupted by recesses. Then the running of the rotor and control body relative to each other is defined only and exclusively by the actions of the pure or mainly hydrostatic forces on the botoms of the respective cylinder in counter opposite action to the forces acting out of the high pressure control port and the sealing lands between it and the unloading recess or recesses. These either hydrostatic or hydrodynamic forces must be applied and separately considered. Thereafter, when so desired and suitable, they can become combined to a desired action of a combination of them. Thereby the outer bearing lands 57 and 58 are either prevented, not provided or are provided in a short or in a long axial dimension or extension.

For the eccentricity between the axis of the rotor and the axis of the control body 70 of for example FIG. 11, there must be a clearance in radial direction between the rotor and the control body. The possibility of radial off centering between rotor and control body, seen also by the departure of rotor axis 71 from control body axis 70, may be done by a coupling between the shaft and the rotor of the machine, as described before. But it may, however, also be done by the provision of a radial and/or spherical flexibility or movability to the control body. The control body would then be a radially free control body as for example in my U.S. Pat. Nos. 3,062,151; 3,136,260 or the like.

THE ACTUAL DESIGN OF DEVICES OF THE INVENTION

Herebefore the principles of the invention have been described. For the actual design of a proper functioning device of the invention, an additional knowledge and skill is required. This will be explained at hand of FIGS. 32 to 38, wherein FIG. 32 defines the values and calculation details which are to be used to calculate the details of design of a device of the invention.

The upper left portion of FIG. 32 shows a view through a device of the invention, in principle similar to the beforegoing Figures. The arrowed lines therein define the sectional view on the right top and the view onto the details in the Figure below the top left Figure. Shown are the cylinder, the cylinder passage, the control port, the unloading recesses and the unloading passage. No referential numbers are written in this Figure because the details are already known from the earlier described Figures and this Figure 32 shall concentrate exclusively on the geometric and mathematical details. New is in this Figure that the axial lengths of the sealing lands right and left of the control port are defined by the letter "x". The half lengths of these sealing lands are defined by the letter "h". Looking now at the top right portion of the Figure it will be seen that the length "B" (in peripherial direction) lies between two angles "gamma" with the mean line between these angles going vertically in the Figure through the upper closing arch. Defined in this Figure portion is further the radius "R" of the inner face of the rotor, equal to the half of the diameter of the rotor's hub. The letter "p" defines the pressure in fluid and the letter "n" defines the number of cylinders in the respective piston group. By geometrical considerations one obtains the new knowledge, that "B" equals "$2R \times \sin \gamma$". This is a new consideration relative to the earlier discussed Figures. In the earlier discussed Figures and mathematical considerations exclusively the basic matters between the cylinder, cylinder passage, control port and unloading recesses were discussed. Now, however, the additional fact is taken into consideration, that the peripherial length "B" between two neighboring rotor passages depends on the diameter of the inner face of the rotor. It increases with the diameter of the inner face in proportion to the increase of this diameter. Consequently, the length "B" of the earlier calculations now is a function of the diameter of the rotor's hub. In the Figure portion below the top left Figure portion it is also defined that for the present calculation the diameter of the cylinder port or passage shall be "d=C" whereby "C" goes into the further calculation. Applying now the earlier in this application obtained knowledges, the following equation:

$$X = \frac{[L - C]}{2} = D^2 \frac{\pi}{4} \frac{fb}{B} - C \tag{21}$$

appears under the assumption that the pressure drop over the sealing lands between the control port and the unloading recesses will be linear. (Derivations from the linearity due to heating and speeds may be adjusted, accordingly, by changing "P/2" to an adjusted value.) Further defined in this consideration and in the above equation is the radial thrust factor "fb" and is suggested for high speed operation with small friction to be "fb=1.02 to 1.20". In the calculation tables on the bottom of the Figure this factor is taken to be 1.04. The above equation (21) then defines the condition at which the rotor will run fully eccentrically respective to the rotor with the smallest possible friction at the line where the clearance is "zero". Note, that "x" is the axial length of the sealing land and thereby the double of the half lengths "h". The vertical lines in the second Figure from top, left side, show the imagined half length lines of the claims and of the specification. In the calculation tables on the bottom of the Figure, wherein the above equation (21) is used, the cylinder diameters "D" are all times in the calculation the same, namely "20 mm" diameter. Downwards in the tables the diameters "d" of the rotor ports are changed. And in the tables to the right from the leftmost table the diameters "R" are changed.

The result of this calculation now is, as the tables show, that the half length lines and the sealing land lengths vary drasticly with increase of the diameter of the control body or of the inner face of the rotor. For devices with small diameters of the rotor hub and control body the half lengths and the lengths of the sealing lands are rather long in axial direction, while for bigger diameter (righter tables) the axial lengths "X" of the sealing lands and the half lengths "h" become very short.

This technology must be obeyed to obtain the aim which the invention desires. One sees here that for different diameters of the control body and of the rotor hub the lengths of the sealing lands and of the half length line distances from the axial ends of the control port vary drasticly.

Figure 33:
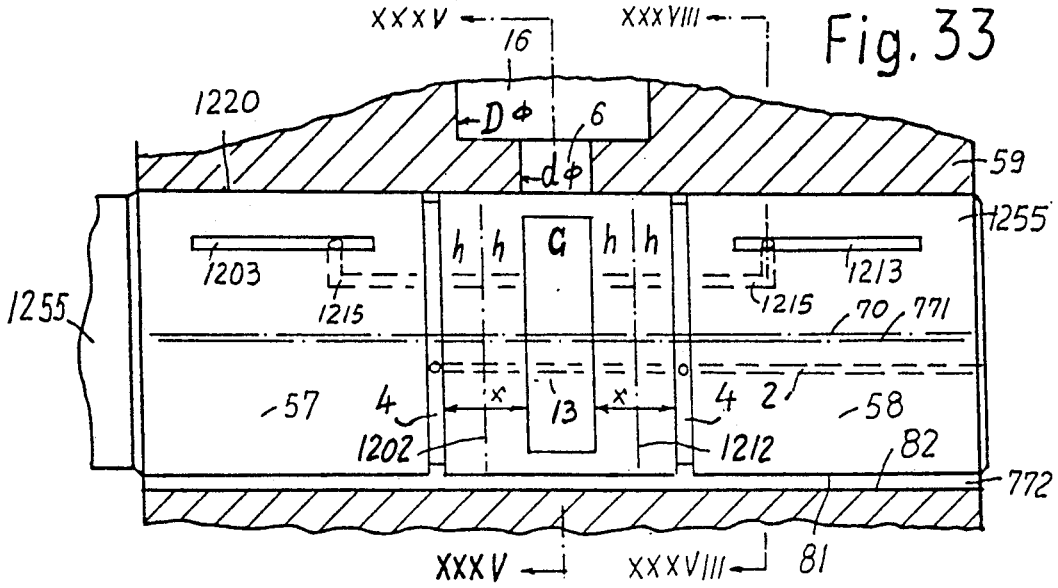
FIG. 33 is a longitudinal sectional view through a rotor with a control body therein.

In FIG. 33 the device of FIG. 21 is shown in part but axially elongated in order to define the details more clearly. Rotor 59 revolves around control body 1255. The axis of the rotor is 771 and the axis of the control body is 70. The outer face of the control body is 81, the inner face of the rotor is 82 and the widest clearance between them, shown in an enlarged scale, is again 772. Control port 13, unloading recesses 4, unloading passage 2 and cylinder 6 with cylinder port 16 are similar to those of FIG. 21. The slots 1203 correspond in principle to slots 3,13 of FIG. 21 and the fluid supply passage(s) 1215 communicates to the high pressure port 13 with high pressure passages 92,92. Axially endwards of the unloading recesses are the bearing lands 57,58 provided which correspond to the lands 66 of FIG. 21 or to the lands 57 and 58 of FIG. 9. It is to be noted here, that these bearing lands are uninterrupted by unloading recesses and that they extend from the respective unloading recess 4 to the respective axial end of the rotor 59. Note also that in FIG. 33 the rotor is fully pressed downward, whereby the outer face of the control body and the inner face of the rotor meet in line 1220 in this Figure. That shall not mean that the lines would meet there in actuality, but it shall mean that line 1220 goes through the upper closing arch of the control body. This definition is done to explain FIG. 34.

Figure 34:
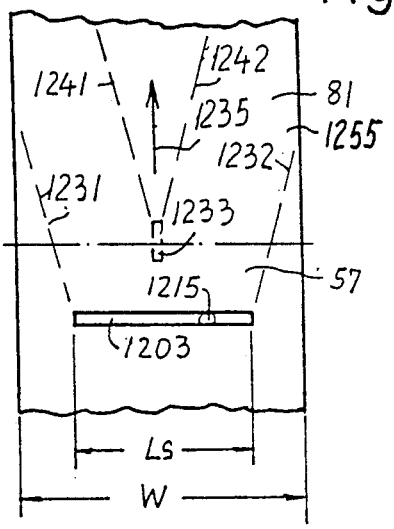
FIG. 34 is a view onto a portion of body 1255 of FIG. 33 from top.

FIG. 34 is a view onto bearing land 57 of FIG. 33, seen from top. The rotor revolves in FIG. 34 in the direction of arrow 1235. The fluid for lubrication and development of the hydrodynamic pressure field 99 of FIG. 28 is supplied throug passage 1215 into slot 1203. Note that slot 1203 has the axial length "Ls" and this length is more than the half of the length "W" of the bearing land 57 in axial direction. A respective analog arrangement exists on the right side in FIG. 33 but is not shown in FIG. 34 because it will be understood at hand of the description of FIG. 34. The fact now is that the fluid out of slot 1203 (3 in FIG. 21) can no immediately flow axialwards to the axial ends of the bearing lands. Since the rotor face runs with high speed in the direction of arrow 1235 the fluid out of slot 1203 is tracted by friction in the direction of the arrow 1203 and flows towards the axial ends in the bearing lands between the dotted lines 1231,1232. If now, as is indicated with dotted lines by referential 1233, the slot 1203 would be replaced by a smaller slot 1233 elongated not in axial direction respective to the axis of the control body but normal thereto and in the direction of the periphery of the control body, then the flow of fluid out thereof would flow between the dotted lines 1241 and 1242 and would reach the axial outer ends of the bearing lands too late to be able to create the hydrodynamic pressure fields 99 of FIG. 28. This shows clearly that the slots 3,1203 of FIGS. 21, 33, 34 must be set elongated in axial direction relative to the control body and thereby parallel to the axis 70 of the control body 15,1255,55 etc.

Figure 35:
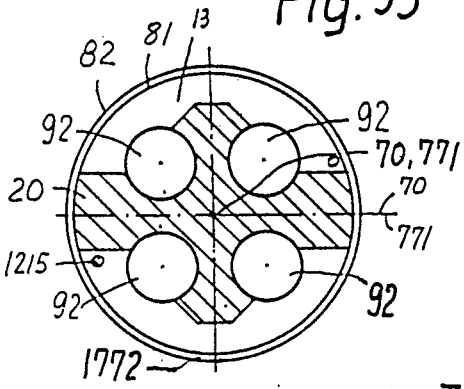
FIG. 35 is a cross sectional view through a portion of the invention.
Figure 36:
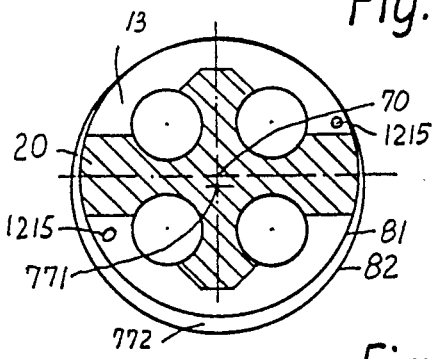
FIG. 36 is a cross sectional view through a portion of the invention.
Figure 38:
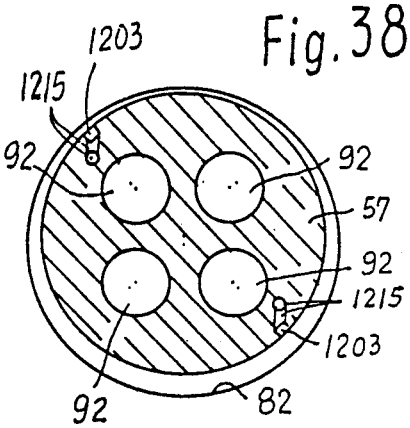
Figure 37:
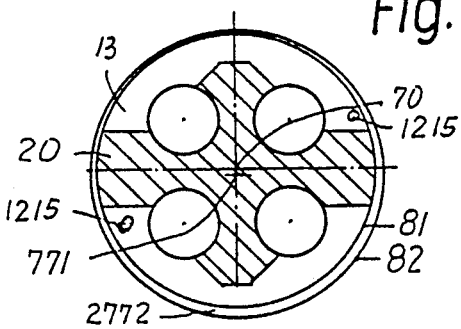
FIG. 37 is also a cross sectional view through a portion of the invention.

FIG. 35 shows the rotor running with its inner face 82 concentrically relative to the control body;

FIG. 36 shows it fully eccentrically running relative to the control body and FIG. 37 shows it partially eccentrically running relative to the control body 20. The axes 70 of the control body and the axes 771 of the rotor are indicated in the Figures and so are the faces 81 and 82.

Since the axially elongated slots supply enough fluid into the axial extension of the clearance araund the bearing lands, proper hydrodynamic pressure fields 99 can now develop. How strong they will be can become calculated at hand of the handbooks for hydrodynamic bearings which are available on the market, if diameter, clearance, sizes of faces, relative speed and relative inclination between the relative to each other moving faces, and the viscosity curves of the lubricant are known. It is now easy at hand of the informations which are given in this patent application, to define at which rate of eccentricity the rotor shall float relative to the control body. It will most be at law speed very close to FIG. 36, at high speed close to FIG. 37.

It is also of interest that some patents of the former art have described such axially short sealing lands that a secure running in proper alignment of the rotor can not be obtained. For a safe and properly directed running of the rotor on the control pintle, axially long surfaces 81 and 82 are required. Therefore, for most of practical applications the device of the invention uses the eccentric running provided by the sizing and location of the imaginary half length lines of the sealing lands and for devices of considerable diameters of the faces 81 and 82 also the counter acting hydrodynamic pressure fileds 99 of the bearing lands. For small diameter control pintles, the bearing lands may be short or may be spared, if the calculation according to FIG. 32 brings axially long enough sealing lands with a capability to keep the rotor relative to the control body in proper and uninclined position. The calculation formula (21) is thereby an important characteristic of the present invention and of its claims. Since the claims describe further details of the preferred embodiments, they are intended to be considered to be a portion of the disclosure of the invention and of the description of the preferred embodiments of the invention.

If the actually used dimensions of "X,D,C,D" of equation (21) are calculated by equation (21) and if thereby the balancing factor "fb" is higher than 1.00, then the invention is obeyed. The rotor will run eccentrically relative to the control body and the result of the invention, to reduce the leakage drasticly, is obtained. If by the calculation it appears that the balancing factor "fb" is 1.00 then the rotor will float concentrically to the control body if no disturbing influences appear and if no radial balancing fluid pressure recesses are applied. If the balancing factor "fb" is smaller than 1.00, then the control body will open the clearance along the high pressure port and a drastic increase of the leakage will appear as was found by this invention. Since the radial fluid pressure balancing of my earlier patents is instabile, the invention is used to overcome this instability.

To inquire whether a device obeys the present invention, is very easy. For that purpose the equation (21) is transformed to:

$$fb = X + C\left[\frac{4B}{\pi D^2}\right]. \tag{22}$$

One can now take the respective measures from the respective device and calculate thereform the radial balance factor "fb".

If "fb" exceeds the value "1.00"; then the device obeys this present invention and falls under the claims. If, however, pressure fields 99 are secured in accordance with the present invention, then the radial balance factor can be increased drasticly if the pressure fields 99 are respectively strong. Thus, if the pressure fields of the present invention are applied, the balancing factor "fb" may be much higher than 1.20, especially if axially relatively long bearing lands 57,58 are applied and if the rotor revolves with high rpm, for example, with several thousand rpm. Therefore, if hydrodynamic pressure fields over the bearing lands 57,58 are applied, their forces must be calculated and evaluated by a respective increase of the balancing factor "fb" of equation (22).

For applying the invention it must be secured that no success preventing means are present. For example, in the present invention fluid pressure balancing recesses on the low pressure port half of the control body are not permitted, because they would disturb the delicate situation of a definite factor "fb". Also conical or tapered control bodies would disturb the effect of the present invention. Specifically the means of a number of Patents which issued in the seventies of our century would, if combined with the present invention, disturb the effect of the present invention because these Patents of the seventieth series are based on catastrophic errors at the evaluation of the technologies which are involved in the effects between control pintles and rotors.

Each length "X" extends from the respective control port to the respective unloading recess. The measure "L" is the sum of "C+2X" and "D" is the diameter of the respective cylinder.

It should be understood that FIG. 32, which is the Figure for the explanation of the geometric-mathematical basics, forms a portion and basis of those Figures, as for example, FIG. 33 etc, which show the wide diameters 16 of the cylinder and the relative thereto much smaller diameter of the passage 6 to and from the respective cylinder.

What is claimed is:

1. A device for intake and expulsion of fluid, comprising, in combination; a hollow housing containing a substantially stationary and a rotary body, a pair of chamber groups of pluralities of individual chambers with means to take in and expel fluid by said chambers and an inner face, forming a concentric cylindrical central bore, in one of said bodies, intake and expulsion conduits and two pairs of high pressure control ports with sealing lands surrounding said control ports in the other of said bodies, with said control ports in alternating communication with the respective intake and expulsion channels of said chambers, the other of said bodies located and closely fitting with its cylindrical outer face in said cylindrical central bore and inner face of the one of said bodies, an axis in said bore defining an axial direction; the said groups of said pairs of groups and the pairs of said control ports distanced from each other in said axial direction; the chambers of the respective group of said chamber groups provided around axes in a plane which is perpendicular to said axial direction, the cross sectional areas of said channels smaller than the cross sectional areas of said chambers, the interior space of said hollow housing substantially free of pressure, wherein an unloading recess is provided medially between and parallel to two control-ports of said pair of control ports, said unloading recess is communicated by respective passage means to said interior space of said housing, wherein portions of said sealing lands are located between said high pressure ports, and;

wherein the axial half length lines of said sealing lands between said high pressure ports and said unloading recess extend partially into the radial inward projections of said chambers, but not into said channels, in order to limit the area of the sealing lands between said control ports and said medial unloading recess.

2. The device of claim 1, wherein one of said bodies is a cylindrical control-body which includes said ports, said recess and said passage means.

3. The device of claim 2, wherein said entrances and exits of said chambers have cross-sectional areas which are smaller than the cross-sectional areas of said chambers to provide a force in said chambers at action of pressure in fluid in said chambers exceeding the force of fluid acting from said control ports against the said inner face, whereby said inner face is pressed partially against said outer face.

4. The device of claim 3, wherein said unloading recess serves to prevent an excessive pressure area between said faces and between said ports and to create a low pressure area between said ports and said faces, to assist that said inner face is and remains partially pressed against said outer face.

5. The device of claim 1, wherein one of said bodies is a cylindrical control-body which includes said ports, said recess and said passage means, wherein said entrances and exits of said chambers have cross-sectional areas which are smaller than the cross-sectional areas of said chambers to provide a force in said chambers at action of pressure in fluid in said chambers exceeding the force of fluid acting from said control ports against the said inner face, wherein said inner face is pressed partially against said outer face, wherein said unloading recess serves to prevent an excessive pressure area between said faces and between said ports and to create a low pressure area between said ports and said faces, to assist that said inner face is and remains partially pressed against said outer face, wherein said control body is unflexibly rigidly fastened in a portion of said housing and provides a high pressure control half and a low pressure control half with an imaginary plane through the closing arcs between said control ports, while a shaft is with a fixed and radially not deplaceable axis provided in bearings in another portion of said housing to permit said shaft to revolve in said bearings, wherein the towards said plane through said closing archs respective projection of the sealing lands between said unloading recess and said control ports divided by two and added by the similar projection of said control ports is smaller than the respective projection through those chambers of said chambers which are communicated to said control ports reduced by the projection of their communicated channels of said channels, and, wherein holding faces are provided on said shaft and said housing to face end face portions of said rotor to prevent axial movement of said rotor while a transfer means which includes thrust faces which are substantially parallel to angularly radially spaced planes through the axis of said rotor is provided to said shaft and said rotor to engage thereto parallel thrust faces which are provided on said rotor to border radial slots in said rotor which extend radially inwards beyond said trust faces of said transfer means into said rotor, whereby said thrust faces on said transfer means and said trust faces on said rotor are able to slide along each other and slide along each other when high pressure fluid flows during revolution of said rotor and said rotor is on said high pressure half closely pressed onto said control body while a wider clearance appears between said rotor and said control body on said low pressure half of said control body and the axis of said rotor is radially distanced from the axis of said control body and the thereto coinciding axis of said shaft.

6. The device of claim 1, wherein the area of said sealing land is substantially slightly smaller than the double of the area of the difference of the radial projection of the respective chamber and the channel of said chambers and channels.

7. In a fluid machine in combination, a rotor revolvably borne in a housing and having a rotor face, a control body associated to said rotor and having a control face sliding and sealing along said rotor face, wherein said housing has ports and fluid passages extending towards said control body, wherein said fluid passages extend through said control body and form control ports in said control face of said control body, wherein rotor passages extend from said rotor face through a portion of said rotor to working chambers provided in said rotor.

wherein fluid can flow through one of said passages from one of said ports into at least one of said chambers and out of said chamber through another of said passages to another of said ports wherein said sealing arrangement includes means for sealing along a portion of said faces, wherein said rotor has a substantially cylindrical and axially extending rotor-hub, having an inner face;

wherein said inner face is said rotor face;

wherein said control body is a substantially cylindrical control body of a diameter only slightly smaller than the diameter of said rotor-hub, wherein said control body extends into said rotor, wherein said control body has a substantially cylindrical outer face, wherein said outer face is said control face, wherein a small, substantially cylindrical, clearance is formed between said faces, wherein said rotor contains two cylinder groups which form said working chambers around working chamber axes and each of said groups consists of a plurality of individual working chambers, wherein said chamber groups are axially distanced from each other along the axis of said rotor and said control body with said chamber axes of a group of said groups located in a radial plane which is perpendicular to said axis of said rotor, wherein the cross-sectional areas of said working chambers exceed the cross-sectional areas of said rotor passages;

wherein said control body has two pairs of control ports;

wherein at least one unloading recess is provided between two of said control ports of a respective pair of said pairs;

wherein a low pressure space is provided in said housing;

wherein a passage means is provided in said control body and extends from said unloading recess through said control body to said space in said housing to communicate and transfer the low-pressure of said space in said housing to said unloading recess and to pass fluid which might enter said unloading recess through said passage means into said space in said housing;

wherein said cylinders have rotor ports of a smaller diameter than the diameter of said cylinders, whereby a bottom portion is formed between said cylinders and said rotor ports for the reception of the action of the fluid pressure of the cylinder on said bottom portion and wherein said unloading recesses restrict the pressure in said clearance in the neighborhood of said rotor ports to a radially outward directed force of less force than the radially inwardly directed force of pressure onto the respective bottom portion of the respective cylinder is in order that the difference of said forces presses said rotor face against a portion of said cylindrical control face of said control body, wherein sealing lands are provided around and between said high pressure ports, and;

wherein the axial half-length lines of said sealing lands between said control ports and said unloading recess extend partially into the radial inward projection of said working chambers but remain outside of the radial projection of said rotor passages.

8. The fluid machine of claim 7, wherein at least two unloading recesses are provided between said two of said ports;

wherein at least one unloading recess is provided as an additional unloading recess on the outer side of each of said two control ports; and;

wherein said passage means communicates to all of said unloading recesses.

9. A device for intake and exhaust of a fluid, comprising, in combination, a hollow housing containing a substantially stationary and a rotary body, a pair of chamber groups of pluralities of individual working chambers around working chamber axes with said chambers provided with means to take in and expel fluid by said chambers in one of said bodies, intake and expulsion conduits and two pairs of low pressure- and high pressure-control ports in the other of said bodies in alternating communication with the respective intake and expulsion channels of said chambers, the cross sectional areas of said channels smaller than the cross-sectional areas of said chambers, one of said bodies located and closely fitted with its cylindrical outer face in a cylindrical concentric bore and an inner face of one of said bodies with said inner face bordering said bore, an axis in said bore defining an axial direction, the groups of said pair of groups and said pairs of said control ports distanced from each other in said axial direction, the chambers of the respective chamber group with their chamber axes provided in a radial plane which is perpendicular relative to said axial direction, the interior space of said hollow housing substantially free of pressure which would exceed the lowest pressure in said device and an unloading recess provided medially between and parallel to the high pressure control ports of said pairs of control ports, said said unloading recess communicated by respective passage means to said interior space in said housing, wherein sealing lands are provided around and between said control ports, and; wherein the axial half length lines of the sealing lands between said high pressure ports and said unloading recess extend partially into the radial inward projections of said chambers but not into said channels to limit the area of said sealing lands between said control ports and said medial unloading recess to a size which is substantially slightly smaller than the double of the difference of said radial projections of the respective chamber and channel of said chambers and channels.

10. A radial piston machine with pistons reciprocating in and fluid flowing through cylinders in a rotor which has a hollow cylindrical central rotor hub and a cylindrical control body with fluid conduits communicated to high pressure and low pressure control ports in said control body with sealing lands surrounding said control ports; rotor ports communicating said control ports with said cylinders and forming cylinder bottoms between said rotor ports and the walls of said cylinders while the imaginary radial extension inwardly directed of said cylinder walls and rotor ports would define the projections of said bottoms onto said control body;

wherein unloading recesses are provided axially of the sealing lands of the high pressure port of said control ports, parallel to said high pressure port and the imaginary axial half length lines of the sealing lands between said high pressure control port and said recesses are partially within said projections of said bottoms of said cylinders, while said recesses are communicated by passages to a space under substantial low pressure in the machine, whereby the cross-sectional area of said bottoms in said cylinders are 5 to 50 percent of the half of the area of the sealing lands between said rotor, said high pressure port and said recesses, and, wherein said recesses are unloading grooves which unload fluid from the clearance between the rotor and the control body into said space of low pressure.

11. The machine of claim 10, wherein the force of pressure in fluid in said cylinders acting onto said bottoms of said cylinders in the radial inward direction towards said control port and sealing land of said control body exceeds the sum of pressure forces in fluid in said high pressure control port and along said sealing land between said high pressure port, said rotor and said recesses, whereby said rotor is subjected to a force in the direction towards the center of said high pressure control port and thereby tends to narrow the clearance between said control body and the inner face of said rotor in the neighborhood of said high pressure control port.

12. The machine of claim 11, wherein axially behind said recesses two outer bearing lands are formed and provided by the respective portions of the outer face of said control body, whereon hydrodynamic centering forces are building which increase in intensity and strength with increasing relative speed of said rotor along said bearing lands and with the increase of the rate of eccentricity between said rotor and said bearing lands of said control body, wherein said hydrodynamic centering forces are diametrically oppositionally directed relative to said pressure in fluid onto said cylinder bottoms in said cylinders, whereby the sum of said hydrodynamic centering forces together with said sum of forces out of said high pressure control port and said sealing in opposition to said forces which act into said bottoms in said cylinders define the rate of eccentricity between said rotor and said control body.

13. A radial piston machine with pistons reciprocating in and fluid flowing through cylinders in a rotor which has a hollow cylindrical central rotor hub and a cylindrical control body with fluid conduits communicated to high pressure and low pressure control ports in said control body with sealing lands surrounding said control ports; rotor ports communicating said control ports with said cylinders and forming cylinder bottoms between said rotor ports and the walls of said cylinders while the imaginary radial extension inwardly directed of said cylinder walls and rotor ports would define the projections of said bottoms onto said control body;

wherein unloading recesses are provided axially of the sealing lands of the high pressure port of said control ports, parallel to said high pressure port and the imaginary axial half length lines of the sealing lands between said high pressure control port and said recesses are partially within said projections of said bottoms of said cylinders, while said recesses are communicated by passages to a space under substantial low pressure in the machine, wherein said recesses are unloading grooves which unload fluid from the clearance between the rotor and the control body into said space of low pressure, and;

wherein said sealing lands have the axial length "x", said imaginary half length lines have the distances "h=x/2" from the axial ends of the respective control ports, the axial distance between said unloading recesses is "L" the diameter of the respective rotor passage from the rotor hub to the respective cylinder is "d"="C", the diameter of the respective cylinder is "D", the half of the diameter of the inner face of the rotor is "R", the rotor has "n" cylinders in the respective cylinder group and the peripheral length of the distance between axes of neighboring cylinders is "B" at the diameter of the inner face of the rotor and "B" is defined by the sinus of 360 divided by "2n" multiplied with 2 of said "R" and the radial balance factor "fb" of equation $$fb = X + C[4B/\pi D^2]$$

exceeds 1.00; whereby the fluid in the respective cylinders presses said rotor to close run on the control body in the high pressure half of said control body to reduce the leakage out of said high pressure port of said control body.

14. A device for intake and exhaust of fluid, comprising, in combination, a hollow housing containing a substantially stationary and a rotary body, a chamber group of individual working chambers around working chamber axes with said chambers provided with means to take in and expel fluid by said chambers in one of said bodies, intake and expulsion conduits and a pair of control ports which are surrounded by sealing lands while forming a high pressure- and a low pressure- control port in the other of said bodies in alternating communication with the respective intake and expulsion channels of said chambers, the cross sectional areas of said channels smaller than the cross-sectional areas of said chambers, one of said bodies located and closely fitted with its cylindrical outer face in a cylindrical concentric bore and an inner face of one of said bodies with said inner face bordering said bore, an axis in said bore defining an axial direction, the group of said chambers and said control ports are provided symmetrically around a radial plane which is perpendicular relative to said axial direction, the interior space of said hollow housing substantially free of pressure which would exceed the lowest pressure in said device, said stationary body provided as a control body with fluid conduits communicated to control ports in said control body, rotor ports communicating said control ports with said cylinders and forming cylinder bottoms between said rotor ports and the walls of said cylinders while the imaginary radial extension inwardly directed of said cylinder walls and rotor ports would define the projections of said bottoms onto said control body;

wherein unloading recesses are provided axially of the sealing lands of the high pressure port of said control ports, parallel to said high pressure port and the imaginary axial half length lines of the sealing lands between said high pressure control port and said recesses are partially within said projections of said bottoms of said cylinders, while said recesses are communicated by passages to a space under substantial low pressure in the machine, whereby the fluid in said cylinders presses the rotor to close run on the control body in the high pressure half of the control body to reduce the leakage out of the high pressure port of said control body, wherein said recesses are unloading grooves which unload fluid from the clearance between the rotor and the control body into said space of low pressure, and;

wherein said sealing lands have the axial length "x", said imaginary half length lines have the distances "h=x/2" from the axial ends of the respective control ports, the axial distance between said unloading recesses is "L" the diameter of the respective rotor passage from the rotor hub to the respective cylinder is "d"="C", the diameter of the respective cylinder is "D", the half of the diameter of the inner face of the rotor is "R", the rotor has "n" cylinders in the respective cylinder group and the peripheral length of the distance between axes of neighboring cylinders is "B" at the diameter of the inner face of the rotor and "B" is defined by the sinus of 360 divided by "2n" multiplied with 2 of said "R" and the radial balance factor "fb" of equation $$fb = X + C[4B/\pi D^2]$$

exceeds 1.00.

15. The device of claim 14, wherein axially of said unloading recesses bearing lands are provided on said control body by extending the outer face of said control body and the inner face of said rotor axially an axial length of at least one fourth of the diameter of said control body, wherein axially extending slots are provided in said bearing lands and communicated by passages to a space which contains fluid and supplies through said passages fluid into said slots in order to create hydrodynamic pressure fields between said control body and said rotor when said rotor revolves, and, wherein said radial balancing factor "fb" exceeds 1.04.

* * * * *